US006596454B2

(12) United States Patent
Adachi et al.

(10) Patent No.: US 6,596,454 B2
(45) Date of Patent: Jul. 22, 2003

(54) TONER AND MANUFACTURING METHOD THEREOF

(75) Inventors: Katsumi Adachi, Nara (JP); Masamitsu Sakuma, Hirakata (JP); Kiyoshi Toizumi, Nara (JP); Taisuke Kamimura, Kitakatsuragi-gun (JP); Tadashi Iwamatsu, Nara (JP); Kenji Mishima, Fukuoka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/844,150

(22) Filed: Apr. 27, 2001

(65) Prior Publication Data

US 2001/0036586 A1 Nov. 1, 2001

(30) Foreign Application Priority Data

Apr. 27, 2000 (JP) ..... 2000-128439

(51) Int. Cl.[7] ..... G03G 9/087
(52) U.S. Cl. ..... 430/137.18; 430/137.1
(58) Field of Search ..... 430/137.1, 137.18

(56) References Cited

U.S. PATENT DOCUMENTS 5,702,852 A * 12/1997 May et al. ..... 430/45
5,725,987 A 3/1998 Combes et al.
5,854,311 A * 12/1998 Richart ..... 523/309

FOREIGN PATENT DOCUMENTS

EP 0735051 A1 * 10/1996

OTHER PUBLICATIONS

Diamond, A. S., *Handbook of Imaging Materials*, Marcel Dekker, Inc, NY (1991), pp 168–170.*

*The Application of Supercritical Fluid to Raw Material Preparation,*. New Ceramics (1995) No. 1, pp. 7–13, with partial translation.

* cited by examiner

*Primary Examiner*—Janis L. Dote
(74) *Attorney, Agent, or Firm*—George W. Neuner, Esq.; Edwards & Angell, LLP

(57) ABSTRACT

According to a toner and a manufacturing method of the present invention, the toner, which is composed of a binding resin component precipitated in particle shapes with a coloring agent component dispersed in the binding resin component, is produced by dissolving the binding resin component in a supercritical fluid (a SCF), blending the coloring agent component in the SCF, and lowering solubility of the binding resin component for precipitating the binding resin component in the particle shapes. Even when the coloring agent content is increased, by the SCF, the toner can maintain dispersibility of the coloring agent component in the binding resin component precipitated in the particle shapes, meanwhile coloring power is also maintained thereby. Therefore, the toner can promote miniaturization of an image forming apparatus using the toner.

18 Claims, 9 Drawing Sheets

TONER AND MANUFACTURING METHOD THEREOF

FIELD OF THE INVENTION

The present invention relates to a toner for developing an electrostatic latent image formed on an image carrier by an electrophotographic process or an ion-flow method, and manufacturing methods thereof.

BACKGROUND OF THE INVENTION

Image forming apparatuses, which employ an electrophotographic method, create an image by fixing a toner image on a recording medium. Examples of the image forming apparatuses are a laser printer, a Light Emitting Diode (LED) printer and a digital photocopying machine.

In the electrophotographic method, an electrostatic latent image, which is in accordance with image information, is visualized by the toner (a developer) thereby creating a visible image. The visible image (a toner image) is transcribed and fixed on the recording medium. The electrostatic latent image is produced by electrifying the entire surface of a photoreceptor, then by irradiating the surface with light in accordance with the image information by use of a laser beam or LED. The visible image is created by the visualization of the electrostatic latent image with the toner (the developer) by a developing section. The fixation of the visible image onto the recording medium is carried out at a fixation section by fixing on the recording medium the visible image of the toner which was transferred onto the recording medium at a transfer section.

There has been greater demand for more compact image forming apparatuses, recently. In an image forming apparatus of the electrophotographic method, a toner storing section is targeted for size reduction to achieve miniaturization of the image forming apparatus because its occupying space is significantly large in the image forming apparatus. A large quantity of the toner must be stored in the image forming apparatus for user's convenience since the image forming apparatus may be used by more than one person and with a great number of printout, especially in the recent network environment.

Demand for color image output also has been increased recently. A color image forming apparatus, in which toners of three or four colors are used, needs a much larger space for a toner storing section in the image forming apparatus. Moreover, a bulky fixation section is necessary in case of a color image because the color is expressed by multi-color overlapping with a greater consumption of the toner on the recording medium such as paper or an Over Head Projection (OHP) sheet, thus requiring a greater application of heat for the thermal fixation, compared to the case of a monochrome image.

In addition, there is demand for a further energy-saving and environment-friendly method for manufacturing the toner. Today's common manufacturing methods of the toner are: (a) a method that involves melting, kneading, and grinding processes (MKG method), which has been employed conventionally, and (b) polymerization methods in a liquid solvent, which has been introduced recently. Known as the polymerization methods are, for example, suspension polymerization, emulsion polymerization, and dispersion polymerization methods.

Generally, the quantity of a coloring agent (carbon black or color pigments) contained in the toner is ranging from a few % up to about 10% by weight. The quantity of the toner necessary for achieving necessary image-intensity is between about 0.7 mg/cm$^2$ and 1 mg/cm$^2$. Due to those requirements, the image forming apparatus should store a large quantity of the toner, as described above.

Therefore, the quantity of the toner necessary for expressing the image information can be reduced by increasing the coloring agent content in the toner, thereby resulting in a smaller space occupied by the toner storing section in the image forming apparatus.

However, poor dispersibility of the coloring agent in the toner is often caused in the conventional toner and the conventional methods thereof when the coloring agent content in the toner is increased for reducing the quantity of toner used. With the poor dispersibility, the increase in the coloring agent content reduces the coloring power of the coloring agent, on the contrary.

Moreover, it is very difficult to further improve the dispersibility of the coloring agent in the polymerization methods. For example, the suspension polymerization method, which is the most popular among the polymerization methods, has difficulty in increasing the coloring agent content further than the current level with satisfactory dispersibility maintained. It is because the re-agglomeration of coloring agent particles tends to occur during the polymerization reaction with the increase in the quantity of the coloring agent, besides the problem in uniform dispersion of the raw materials (a mixture of monomers or coloring agents).

In addition, with respect to the dispersion of the coloring agent, the MKG method has an advantage over the polymerization methods that the large shear force is large in the melting and the kneading processes and the re-agglomeration of the coloring agent particles is prevented by a rapid cooling process following the kneading process.

However, for the toner produced by the MKG method, the way of manufacturing the toner, that is, preparing a chip of a resin by melting and kneading, then grinding down the chip to targeted particle diameters, leads to susceptibility of the chip to cleavage at its resin part containing the coloring agent particles during the grinding process, so that the toner has a structure with a number of the coloring agent particles exposed from the surface of the toner. This has an adverse effect on the electric characteristics (charge characteristics) of the toner.

Moreover, the toner of the MKG method is mechanically weak at the interface between the coloring agent particles and the binding resin when a large quantity of the coloring agent particles is mixed in, so that stabile production of the toner with targeted particle-size distribution cannot be achieved due to the damage on the particles during the grinding process.

Further considering effects on the environment, the polymerization methods require some environmental measures such as washing and waste-fluid treatments for their organic solvents used in a large quantity. Furthermore, because the toner is produced in a liquid, the polymerization methods need a drying process that consumes a huge quantity of energy.

SUMMARY OF THE INVENTION

In view of the foregoing conventional problems, the present invention has an object to provide a toner and its manufacturing methods, by which a desirable image quality is achieved with a small quantity of the toner, as well as energy saving, by use of a supercritical fluid (a SCF) or a sub-supercritical fluid (a sub-SCF) while increasing a coloring agent content in the toner and maintaining dispersibility of the coloring agent.

In order to solve the above problems, a toner manufacturing method of the present invention includes at least the steps of (a) dissolving a binding resin component in a SCF or a sub-SCF so that the binding resin component is blended with a coloring agent component, (b) lowering solubility of the binding resin component so that the binding resin component is precipitated in particle shapes, thus producing a toner with the coloring agent component dispersed in an interior of the binding resin component precipitated in the particle shapes.

With the above method, use of the SCF or the sub-SCF gives good dispersibility of the coloring agent component in the thus produced toner, even when the coloring agent content is increased. This maintains good image formation free from the conventional problems, such as low coloring power due to the increase in the coloring agent content, and unstable toner charge characteristics resulted from the exposure of the coloring agent component.

Moreover, the above method can promote miniaturization of the image forming apparatus using the toner by reducing the quantity of the toner used by way of increasing the content of the coloring agent. Furthermore, shorter precipitation time for the binding resin component can reduce the energy and production cost of the toner production with the above method, compared to the conventional polymerization methods and the MKG method for manufacturing a toner.

In order to solve the foregoing problems, another toner manufacturing method of the present invention includes the steps of (a) blending core-forming toner particles, which include at least the binding resin component and coloring agent component, with a surface modifier component to be applied on the surface of the core-forming toner particles in a SCF or a sub-SCF, (b) lowering solubility of the surface modifier component after dissolving the surface modifier component so that the surface modifier component is precipitated on the surface of the core-forming toner particles, thereby producing a surface modified toner.

Therefore, with the above method, the exposure of the coloring agent component from the surface of the toner can be reduced by coating the surface with the surface modifier component. Thus, excellent charge characteristics of the product toner are achieved even for the toner with high coloring power given by containing a large quantity of the coloring agent component in the core-forming toner particles.

Furthermore, the toner prepared by the above method also has excellent mechanical strength by being coated with the surface modifier component. This can reduce breakdown of the toner after a long usage, thereby providing stable images as well as lowering the energy consumption and production cost of the toner manufacturing.

The toner of the present invention is manufactured by either of the manufacturing methods, in order to solve the foregoing conventional problems. For the solution of the forgoing conventional problems, another toner of the present invention is composed of a binding resin component of particle shapes and coloring agent component dispersed in the binding resin component, in which the dispersion of the coloring agent component is carried out using the SCF or the sub-SCF.

In the above arrangement, accordingly, the coloring power of the coloring agent component can be maintained due to excellent dispersibility of the coloring agent component, even when a coloring agent content is set to be large.

As a result, the above arrangement contributes to the miniaturization of the image forming apparatus using the toner, still maintaining the excellent image forming ability even with less toner.

For a fuller understanding of the nature and advantages of the invention, reference should be made to the ensuing detailed description taken in conjunction with the accompanying drawings.

BRIEF DESCRIPTION OF THE DRAWINGS

FIG. 4(*b*) is an explanatory view illustrating the agglomeration between the toner particulates produced in the toner manufacturing method where the entrainer component and the binding resin component are compatible to each other, and indicating a post-agglomeration state.

FIG. 8(*b*) is an explanatory view of the toner in the example 10 of the present invention, showing the toner with coating by the surface modifier component.

FIG. 9(*b*) is an explanatory view of the toner in the example 11 of the present invention, showing the toner with coating by the surface modifier component.

DESCRIPTION OF THE EMBODIMENTS

Figure 1:
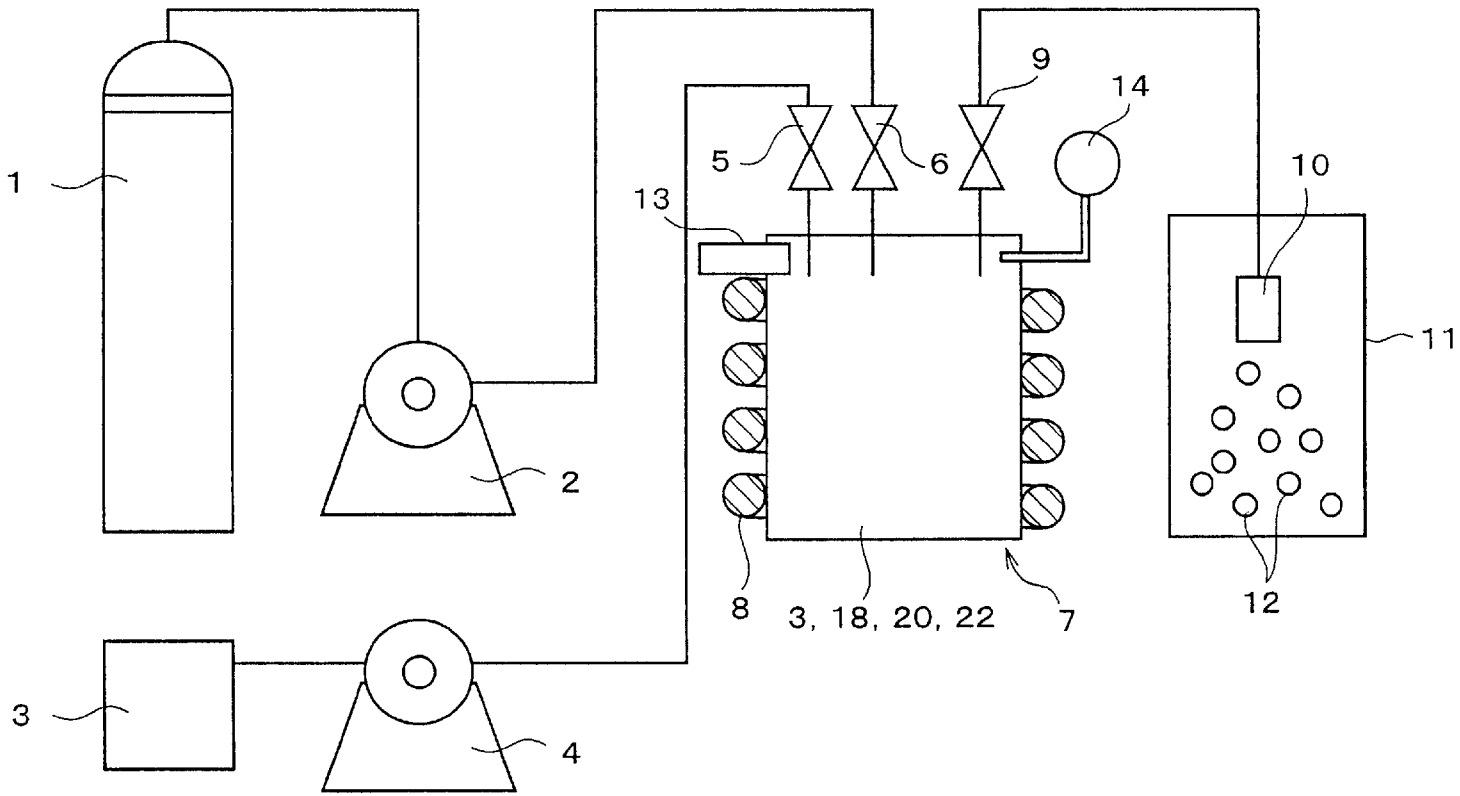
FIG. 1 is a schematic diagram illustrating a structure of a toner manufacturing apparatus for producing a toner of the present invention.

Embodiments of the present invention are explained below, with reference to FIGS. 1 to 7.

First Embodiment

Explained below is a toner of a first embodiment of the present invention, referring to a manufacturing method thereof. The manufacturing method involves steps of: (a) dissolving binding resin component in a SCF or a sub-SCF so that the binding resin component is blended with a coloring agent component, (b) lowering solubility of the binding resin component in the SCF or the sub-SCF so that the binding resin component is precipitated in particle shapes with the coloring agent component dispersed in an interior of the binding resin component.

A substance will be in a fluid form with equal densities in gaseous and liquid phases where a temperature and a pressure of the substance are set to certain conditions (a supercritical point or higher). The SCF is the fluid at a temperature and a pressure above the vicinity of the critical point. Moreover, a fluid with similar characteristics to the SCF can be obtained in conditions below or close to the critical point. Such a fluid is called as a sub-SCF.

The SCF or the sub-SCF (hereinafter, the term, SCF, denotes the SCF and the sub-SCF inclusive, unless otherwise specified) shows both characteristics of a gas and a fluid at the same time. For example, the SCF possesses density close to that of a fluid (about hundreds times greater than that of a gas), viscosity similar to that of a gas (about 1/10 to 1/100 of that of a fluid), diffusion coefficient smaller than that of a fluid by about 10 to 100 times, and heat transfer coefficient comparable to that of a fluid (about hundred times larger than that of a gas).

The SCF, generally, has a great dissolving power with characteristics to allow the solubility of a substance to be varied greatly in accordance with a change in temperature and pressure. The characteristics make the SCF eminent as a reaction solvent and an extraction solvent. Application of the SCF for separation, extraction, and purification of substances is widely studied in recent years, in the field such as caffeine extraction from coffee and separation and extraction of waste.

Where a targeted substance is dissolved in the SCF, the dissolved substance is precipitated by Rapid Expansion of Supercritical Solution (RESS method) or by addition of a poor solvent or a surfactant, both of which significantly lower solubility of the solute in the SCF, thereby precipitating the dissolved substance. Production of particlulates by applying this feature of the SCF has been put in practice.

For example, Tokukaihei No. 10-133417 (corresponding U.S. Pat. No. 5,725,987, Date of Patent: Mar. 10, 1998) discloses a manufacturing method of particulates by using the SCF. The publication only relates to the manufacturing method of the particulates to be applied on the surface of a toner, but does not teach anything about a manufacturing method of the toner itself.

The present inventors have contrived the present invention by trying various applications of the SCF for the toner production, in view of the above characteristics of the SCF. As discussed previously, it is important to increase the coloring power of the toner for the miniaturization of the image forming apparatus in the electrophotography method using the toner. For that reason, the dispersibility of the coloring agent must be improved for increasing the coloring agent content in the toner.

Where the binding resin component of the toner and the coloring agent component are blended together in the SCF in a reactor, the dissolved substance (the coloring agent component) or the mixed-in substance (particulates of the coloring agent component) are uniformly dispersed without agglomeration, which is prevented by the characteristic high dissolving power and a large diffusion coefficient of the SCF. This produces a good dispersion of the coloring agent component in the SCF.

Subsequently, the precipitation of the dissolved solute components is carried out, for example, by depressurizing the SCF in the reactor. In this stage, the binding resin component, as a dissolved solute, is precipitated in particulate shapes by rapidly lowering the solubility of the solutes in the SCF by the application of the RESS method or the like method. Because of the good dispersion of the coloring agent component in the SCF at this stage, a toner of the particulate shapes can be produced with the coloring agent component more uniformly dispersed in the particulates of the binding resin component.

The substances which can be used as the SCF are: $CO_2$, $N_2$, $C_4$, $C_2H_6$, $CF_3H$, $NH_3$, $CF_3Cl$, $CH_3OH$, $C_2H_5OH$, and $H_2O$, for example.

The binding resin component can be any resin as long as that can be used for a toner, namely: styrene resins, such as polystyrene, styrene-butadiene copolymer and styrene-acrylic copolymer; ethylene resins, such as polyethylene, polyethylene-vinyl acetate copolymer, and polyethylene-vinyl alcohol copolymer; acrylate resins, such as polymethyl methacrylate; phenolic resins; epoxy resins; allyl phthalate resins; polyamide resins; polyester resins; and maleic acid resins, for example. The binding resin component is preferred to have an average molecular weight in a range between $10^3$ and $10^6$.

Listed as the coloring agent component are pigments, namely: Carbon Black, Aniline Blue, Chalco Oil Blue, Chrome Yellow, Ultramarine Yellow, Methylene Blue, du Pont Oil Red, Quinoline Yellow, Methylene Blue Chloride, Phtharocyanin Blue, Rose Bengal, Bisazo Yellow, Carmin 6B, and Quinacridone, for example. The particle diameter of the coloring agent component (primary particles) are ranging from 40 nm to 400 nm, and preferably ranging from 100 nm to 200 nm.

Together with the binding resin component and coloring agent component to be mixed into the SCF, a supplement additive (an entrainer as a solvent) may be added for better affinity between the SCE or the sub SCF and the solutes.

While the choice is also depending on combinations of a substance of the SCF to use and solutes to blend in, listed as the addition-auxiliary are, for example: alcohols, such as methanol, ethanol, isopropanol, and butanol; ketones, such as methyl ethyl ketone, acetone, and cyclohexanone; ethers, such as diethyl ether and tetrahydrofuran; hydrocarbons, such as toluene, benzene, and cyclohexane; esters, such as ethyl acetate, butyl acetate, methyl acetate, and alkyl carbonic ester; halogenated hydrocarbons, such as chlorobenzene and dichloromethane; water; and ammonia. Note that, water and ammonia can be used as an addition-auxiliary only where those substances are not employed as the SCF or the sub-SCF.

Here, an arrangement exemplifying a manufacturing apparatus for producing the toner of the present invention is given in FIG. 1. To begin with, a gas, a substance to be a SCF, is supplied to a reactor from a gas cylinder 1 filled with the substance. The gas is given a targeted pressure by a pressurizing pump 2. Meanwhile, an entrainer (an addition-auxiliary) 3 is also given a targeted pressure by a pressurizing pump 4. The gas and the entrainer 3, with the high pressures, are transferred to a reactor 7 via valves 5 and 6. Here, the temperature of the pressurized gas may be increased close to a targeted level by preheating coils, for example, while it is not shown herein. Further, the supercritical gas and the entrainer 3 may be blended together in advance in another vessel before being introduced into the reactor 7, while it is not shown herein.

It is preferable that a binding resin component 18 and a coloring agent component 20, which are the raw material of the toner, are sealed up in the reactor 7. The reactor 7 is provided with, for example, a heater 8 or a constant-temperature water tank (not shown) to have a targeted temperature. Moreover, by the valves 5 and 6, the pressure in the reactor 7 is controlled to be at a targeted level. The temperature and the pressure are monitored by a thermometer 13 and a pressure gauge 14. In the way described above, a SCF 22, the entrainer 3, the binding resin component 18, and the coloring agent component 20, all in a supercritical state, are blended together in the reactor 7. If necessary, it is also possible at this stage to stir the contents of the reactor 7 by a stirring apparatus, such as that with impeller blades, while it is not shown herein.

Figure 2:
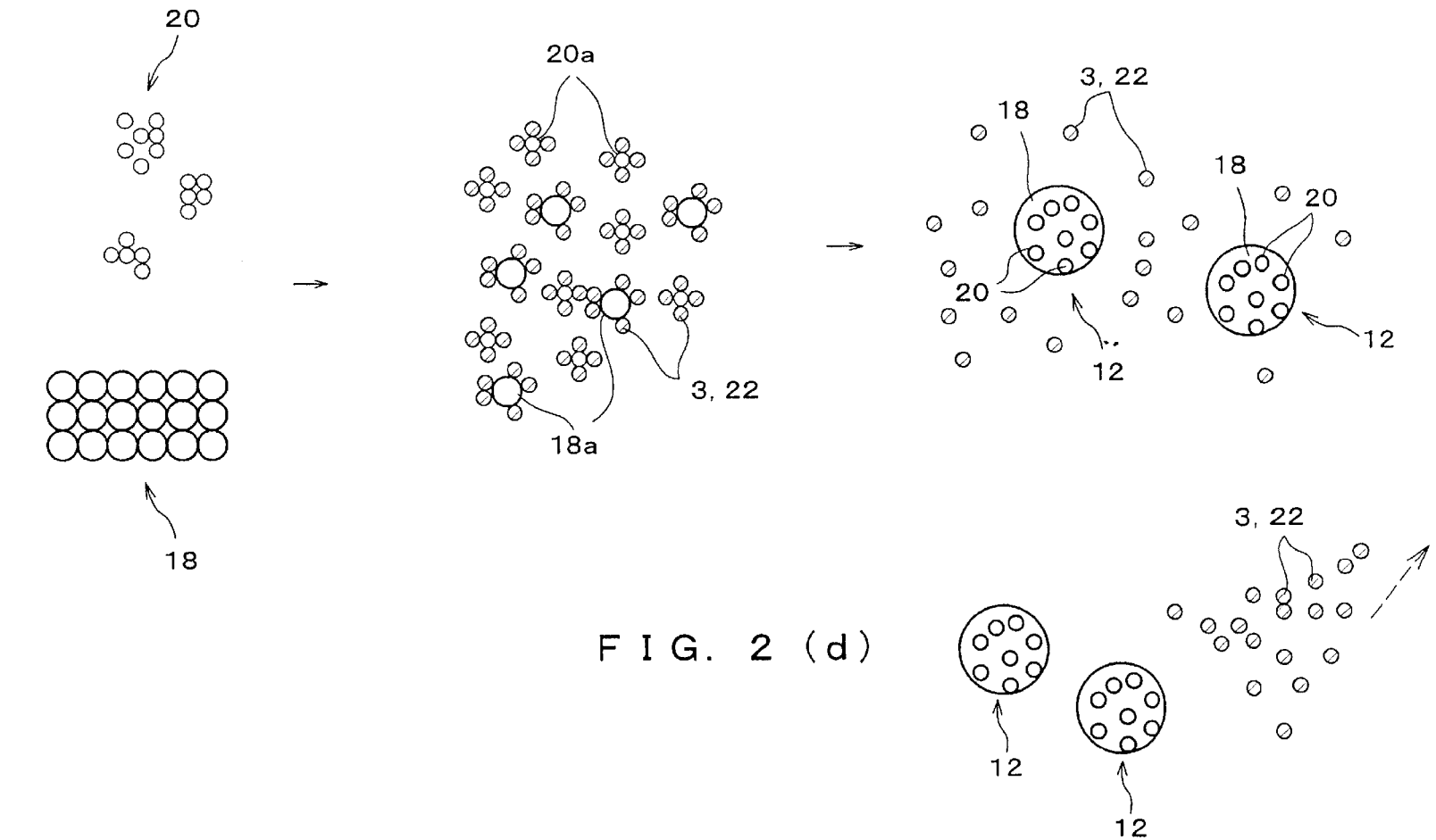
FIGS. 2(*a*) to 2(*d*) are a flow diagram schematically showing manufacturing steps of the toner.

In FIGS. 2 (*a*) through 2 (*d*), illustrated are a flow diagram schematically showing manufacturing steps of the toner using the SCF 22. As shown in FIG. 2(*a*), the binding resin component 18 and the coloring agent component 20 are in a solid state before introduction. As shown in FIG. 2(*b*), in the SCF 22, however, the binding resin component 18 is dissolved in the form of binding resin molecules 18*a* with the supplemental action of the entrainer 3, while the coloring agent component 20 is also dissolved or broken down to primary particles in the reactor 7 to be a dispersed coloring agent 20*a*. The binding resin molecules 18*a* and the coloring agent 20*a* are dispersed and separated from each other by the molecules of the SCF 22 or the entrainer 3 therebetween.

While maintaining the above condition, a depressurizing valve 9, shown in FIG. 1, is opened for rapidly expanding the SCF 22 in the reactor 7. This significantly lowers the solubilities of the respective solutes dissolved in the SCF 22, as the result, the solutes are precipitated respectively in particulate shapes.

In this step, as shown in FIG. 2(*c*), by appropriately setting the affinity between the solutes (the coloring agent component 20 and the binding resin component 18) and the solvent mixture (the entrainer 3 and the SCF 22), and by properly setting the pressure adjustment conditions in the reactor 7, toner particulate 12 can be obtained with the coloring agent component 20 contained with almost uniform dispersion in the binding resin component 18 precipitated in the particulate shapes. The toner particulate 12, in a volumetric average particle diameter of 3 $\mu$m to 7 $\mu$m, are collected via a nozzle 10 in a particle collector 11.

In the above step, use of a solvent, which functions as a poor solvent, can be substitute of the application of the rapid expansion for manufacturing the toner. In other words, the toner can be produced in the following alternative manner: Firstly, the particle collector 11 is filled with a solvent that works as a poor solvent for the solute components dissolved in the SCF 22, for example, such as a gas inert to the binding resin component 18 as one of the solutes. Alternatively, a surfactant (see "New Ceramics" published 1995, No. 1 Page 8) is poured into the particle collector 11. Next, introduction of the SCF 22 into the particle collector 11 results in a rapid precipitation of the solute components, thereby producing the toner particulate 12. Then, the SCF 22 and the poor solvent component or the surfactant component are removed for producing the toner.

If necessary, it is also possible for the toner that for adjusting the fluidity of the toner, a fine powder, for instance, silica, may be subsequently applied on the surface of the toner by well-known methods, for example, use of a dry mixer.

The toner prepared in the above manner shows good dispersibility of the coloring agent component 20 even with a large quantity of the coloring agent component 20, that is, 10% by weight or more with respect to the binding resin component 18. In the toner, the exposure of the coloring agent component 20 from the surface of the toner particulate 12 is less than that of the conventional toners because the majority of the coloring agent component 20 are contained under the surface of the binding resin 18 component.

Figure 3:
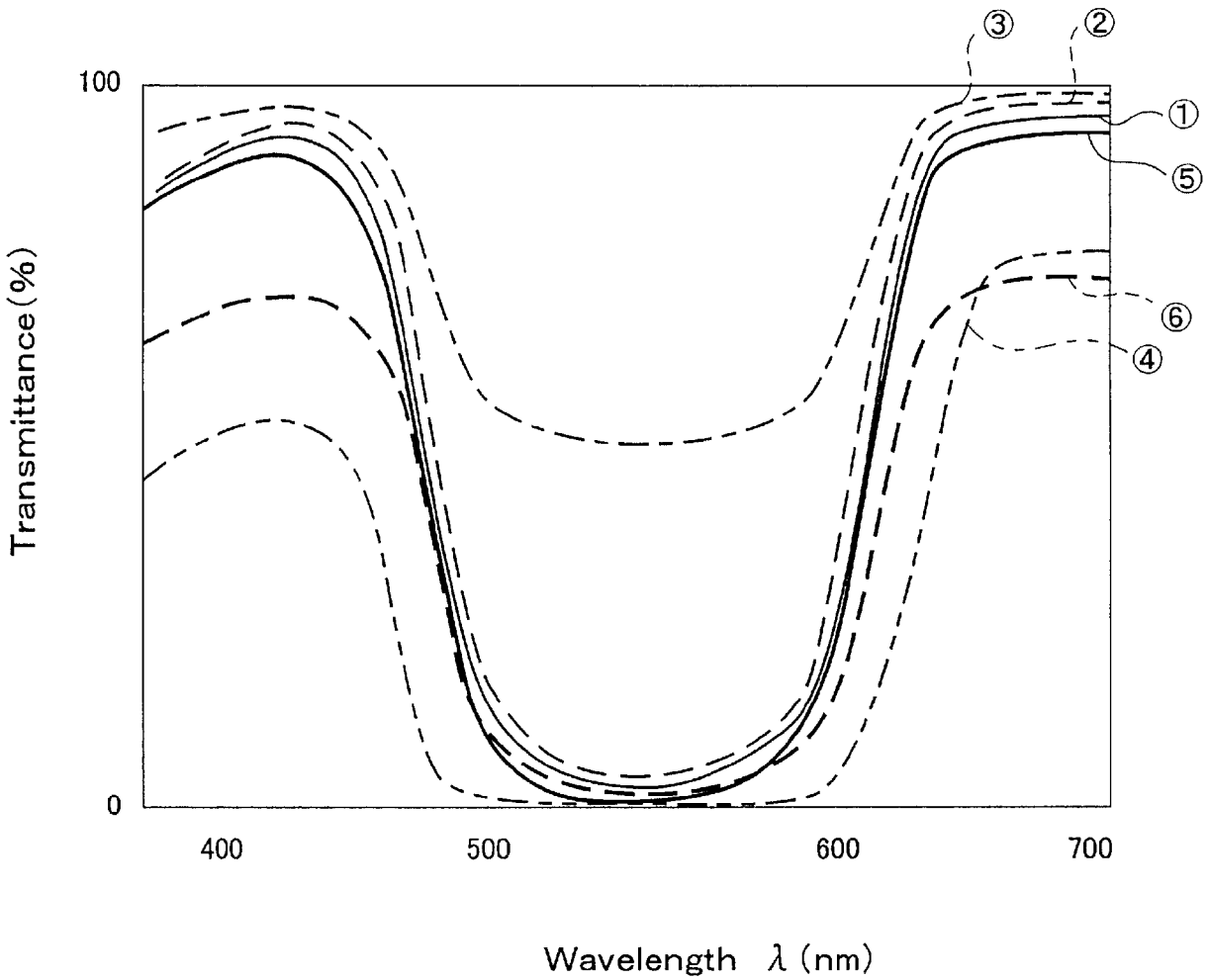
FIG. 3 is a graph illustrating respective spectral transmittance characteristics of each toner of the present invention, comparative conventional toners and a comparative toner.

As shown in FIG. 3, comparing the toner of the first embodiment in accordance with the present invention (indicated by a thin solid line ① in FIG. 3, toner content: 0.2 mg/cm$^2$, coloring agent content: 30% by weight) and a conventional toner produced by a polymerization method, having a standard coloring agent content (indicated by a thin broken line ② in FIG. 3, toner content: 0.9 mg/cm$^2$, coloring agent content: 7% by weight), the former requires a less quantity with respect to a standard quantity of the conventional toner to obtain nearly equivalent targeted spectral transmittance characteristics.

Further, in the case (indicated by alternate long and short line ③ in FIG. 3, toner content: 0.2 mg/cm$^2$, coloring agent content: 7% by weight) where the conventional toner produced by the polymerization method is used in the quantity as small as that of the toner of the first embodiment, the spectral transmittance characteristics for the wavelength range (500 nm to 600 nm) to be absorbed become insufficient due to the small toner quantity, resulting in a poor coloring.

Furthermore, in the case (indicated by alternate one long and two short line ④ in FIG. 3, toner content: 0.3 mg/cm$^2$, coloring agent content: 20% by weight) where the conventional toner produced by the polymerization method is used with a higher coloring agent content, the targeted spectral transmittance characteristics cannot be obtained because of an increased absorption of wavelength ranges (400 nm to 500 nm or 600 nm to 700 nm) supposed to be transmitted, thus resulting in a poor coloring.

Especially for the conventional toner produced by the MKG method, cleavage often occurs at the interface between the coloring agent and the binding resin during the grinding process, thereby leading to the exposure of the coloring agent from the surface of the toner. such conventional toner often shows deteriorated toner charge characteristics, thus causing fog generation or a defective image.

On the other hand, the toner of the present invention shows good toner charge characteristics by preventing the deterioration, and obtains good image formation by avoiding defective coloring. Moreover, the eminence characteristics of the SCF 22 as a reaction solvent give much shorter processing time for the raw materials of the toner particulate 12 to be dissolved, dispersed, and converted into particle shapes, compared to the conventional polymerization methods. Further, no washing/drying process is required after the particle-shaped toner is produced because the SCF 22 as the reaction solvent can be discharged in a gaseous state after expanded by depressurizing.

Generally, the polymerization methods for the toner production need several hours just for the polymerization process and require some more hours for raw-materials-separation process and washing/drying process necessary before and after the polymerization process. The methods of the present invention, compared to the preceding method, take only a period ranging from a few minutes to less than one hour to be completed, thus saving the energy and the production cost for the toner production.

The binding resin component 18 may be prepared by polymerization of at least one type of monomer in the SCF 22. Here, the monomer as a raw material of the targeted binding resin component 18 and an appropriate polymerization initiator are added into the SCF 22, then temperature and pressure are set for the polymerization reaction in the SCF 22. This arrangement also contributes to the price reduction of the thus produced toner not only by giving the above-mentioned effects, but also by cutting the manufacturing cost of the binding resin component 18.

Figure 4:
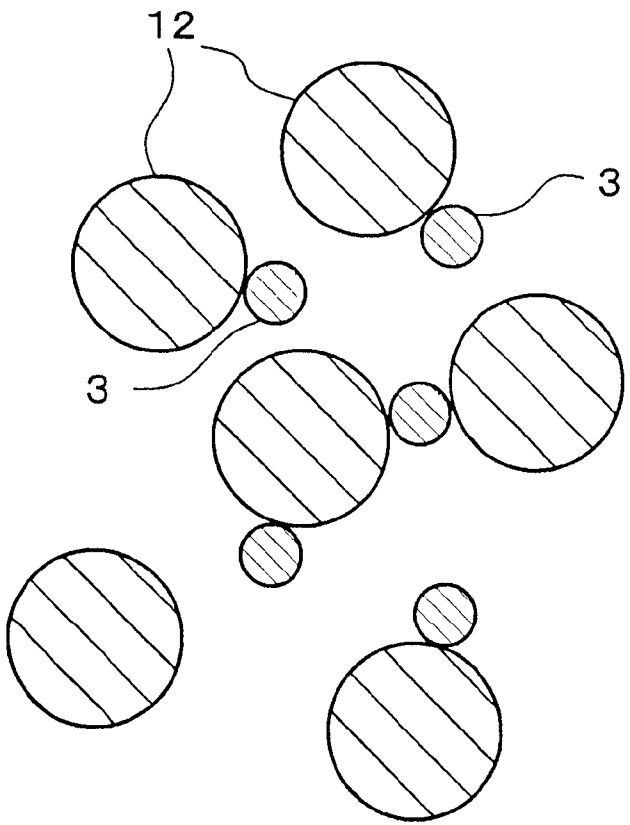
FIG. 4(*a*) is an explanatory view showing agglomeration between toner particulates produced in the toner manufacturing method where an entrainer component and a binding resin component are compatible to each other, and indicating a pre-agglomeration state.
Figure 4:
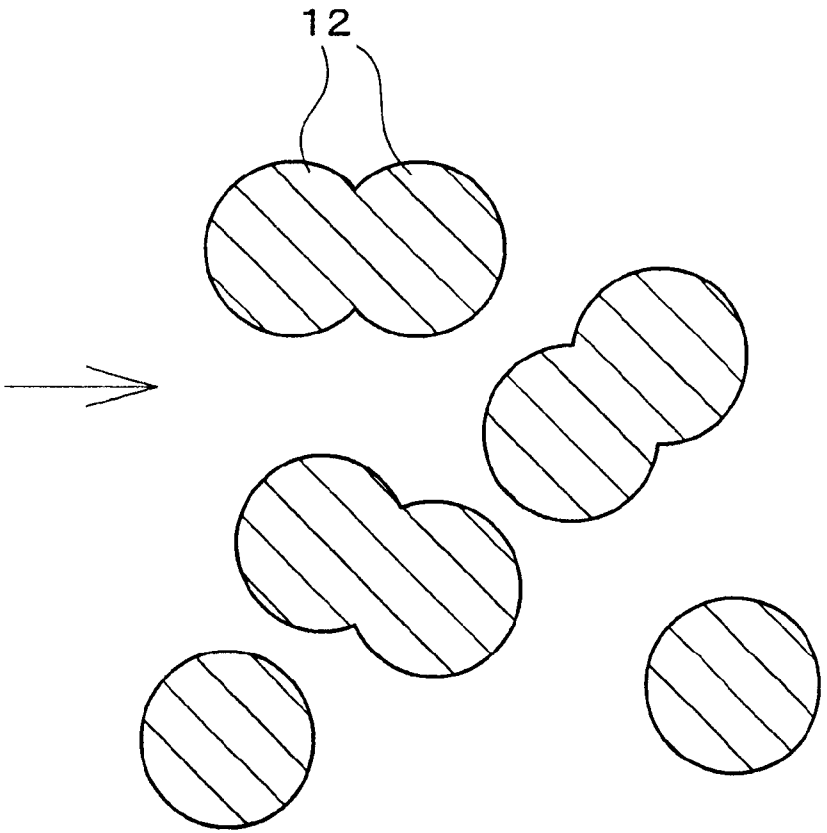
Figure 5:
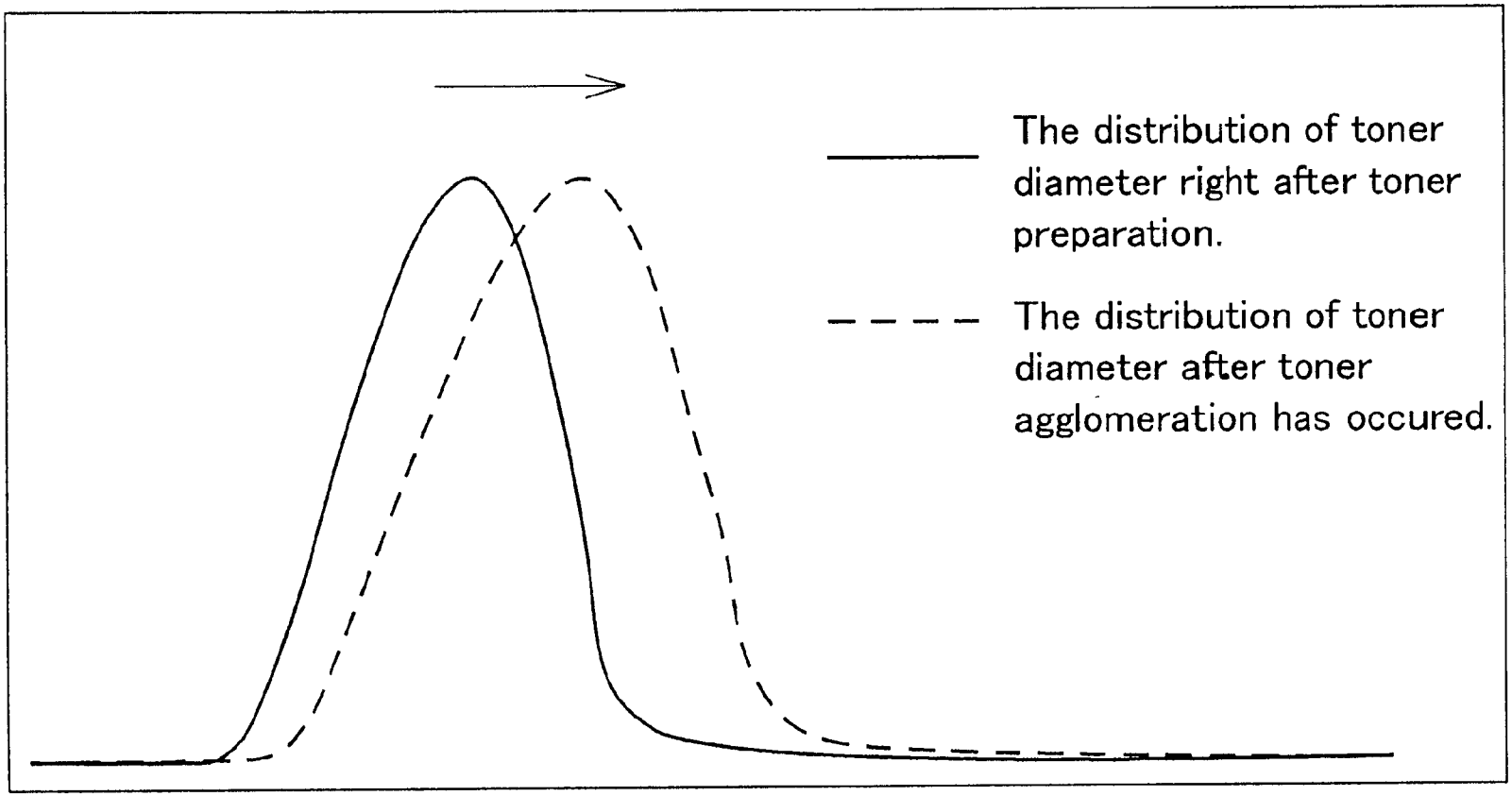
FIG. 5 is a graph showing a change in diameter distribution of the product toner in case that the above agglomeration is taken place.

Furthermore, it is preferable that a substance incompatible to the binding resin component 18 under a condition at ordinary temperature and ordinary pressure is chosen for the entrainer 3. When a trace of the entrainer 3 is left on the toner particulate 12 as shown in FIG. 4(*a*) where the entrainer 3 is compatible to the binding resin component 18, agglomeration of the thus produced toner particulate 12 may be occurred as shown in FIG. 4(*b*), thus hindering the toner from having targeted particle diameters as shown in FIG. 5.

However, the agglomeration of the toner particulate 12 can be prevented by selecting a substance, which is incompatible to the binding resin component 18 under the condition of ordinary temperature and ordinary pressure, to be the entrainer 3. This allows the toner production stably with the targeted particle diameters. Further, this eliminates the need of post-process such as grinding process and classification process after the toner is produced, thus contributing to the cost cutting in the production.

In addition, by using good dispersibility of the coloring agent component 20, which is one of the characteristics of the present invention, it is possible to give the toner a higher quantity of the coloring agent component 20 than that in the conventional methods. This gives a desirable image quality even with less quantity of toner used, thus encouraging the miniaturization of the image forming apparatus storing the toner.

Generally, the toner prepared by the conventional methods has coloring agent content about a few % by weight with respect to 100% by weight of the binding resin content. Thus, the quantity of the coloring agent component 20 to be added is set in a range from 10% to 50% by weight with respect to the binding resin component 18 in the toner for effectively demonstrating the effects of the present invention. This leads to the miniaturization of the image forming apparatus.

There are a wide variety in substances for the SCF 22, but carbon dioxide ($CO_2$) is the most preferable choice. $CO_2$ will be in supercritical state at about 31° C. and about 7.3 MPa. To prepare the supercritial state of $CO_2$ is comparatively easy because of its critical temperature near room temperature. Additionally, $CO_2$, without toxicity and flammability, is suitable in terms of safety. Further, the low price of $CO_2$ as a raw material gas is preferable for achieving a toner at a yet lower price.

In case of a monochrome toner, carbon black is suitable for the coloring agent component 20 to be added in. The carbon black may be in a powder form, or one with graft treatment. There is a high tendency of agglomeration of carbon black particles since the diameter of the primary particle of carbon black is very small, in a range from 10 nm to 100 nm, or preferably from 20 nm to 50 nm.

However, use of the SCF 22, as in the present invention, improves dispersibility of the coloring agent component 20 in the binding resin component 18 of the thus produced toner, by the characteristics of the SCF to facilitate dispersion of solutes. Further, with the relatively low price of carbon black, a toner with good optical characteristics can be provided at a lower price by employing carbon black in good dispersion.

Moreover, pigments with colors such as cyan, magenta, or yellow may be added in for the coloring agent component 20. Here, the toner produced with those pigments may be used as a color toner. To be the coloring agent component 20 for expressing the above colors, the respective pigments mentioned previously may be chosen, for example. Those coloring agent component 20 can be provided in a powder form, or in a masterbatch form in which the coloring agent component 20 in high concentration is added in the binding resin component 18.

As discussed previously, forming a color image using the color toner has much larger consumption of the toner than that of the monochrome image. Thus, use of the toner of the present invention with high coloring power by having a large quantity of the pigments as the coloring agent component 20, is highly effective for the miniaturization of the color image forming apparatus.

It is also possible to include a mold releasing agent (wax) component as a component to be blended in the SCF 22 in the reactor 7. Listed for wax component are polypropylene, polyethylene, and paraffin wax. A wax-core toner can be obtained by having an appropriate affinity between the respective solutes (the wax component, the binding resin component 18, the coloring agent component 20) and the solvent mixture (the SCF 22 and the entrainer 3). For example, by differing solubilities of the respective solutes at the depressurizing step of the SCF 22 (alternatively, at the step for introducing the poor solvent or the surfactant) so that the precipitation of the wax component takes place at first, subsequent precipitation of the binding resin component 18 and the coloring agent component 20 takes place in such a manner that the subsequent precipitated is applied on the particle-shaped wax component precipitated in advance, thereby creating a wax-core toner.

Such wax-core toner preferably has the wax component at its core surrounded with a layer of the binding resin component 18 in which the coloring agent component 20 is dispersed.

Listed below are the manufacturing conditions for the wax-core toner, a. to c., so as to have sequential precipitation, in which the wax component is precipitated firstly, then the coloring agent component 20 and the binding resin component 18 are precipitated secondly via the expansion through pressurization or via the addition of the poor solvent or the surfactant, which are employed at the stage where all the solutes are dissolved in the SCF 22.

Condition a. (The Wax Component is Precipitated)

Only the wax component is precipitated in a certain size under condition that the affinity within the wax component becomes greater than the affinity between the wax component and the SCF 22. Here, the binding resin component 18 is dissolved in the SCF 22, while the coloring agent component 20 is also dispersed in the SCF 22, without agglomeration and in the form of the primary particle.

Condition b. (The Coloring Agent Component 20 and the Binding Resin Component 18 are Precipitated, so that the Coloring agent Component 20 is Dispersed in the Binding Resin Component 18 Precipitated)

The affinity between the coloring agent component 20 and the binding resin component 18 becomes greater than the affinity between those two components and the SCF 22. Meanwhile, the affinity between the wax component and the SCF 22 becomes less than the above affinities. Further, the affinity between the coloring agent component 20 and the binding resin component 18 becomes greater than the affinity between the precipitated wax component and the coloring agent component 20 as well as the binding resin component 18. Therefore, in the SCF 22 at this stage, the precipitated wax component is separated from the binding resin component 18 in which the coloring agent component 20 is dispersed.

Condition c. (The Binding Resin Component 18, where the Coloring agent Component 20 is Dispersed, is Precipitated on the Wax Component)

At this stage, the affinity between the precipitated wax component and the binding resin component 18, in which the coloring agent component 20 is dispersed, becomes greater than any other affinities between the substances in the SCF 22, thus producing the toner in such a shape that the wax component is coated with the binding resin component 18 in which the coloring agent component 20 is dispersed.

When the toner is manufactured in those conditions a. to c., the following conditions A. to C. are set for the affinities between the solute components and the SCF 22 as the reaction solvent having the entrainer 3, and between the respective solute components.

Condition A. (The Wax Component is Precipitated)

The affinity between the wax component and the SCF 22<(the affinity within the wax component, and the affinities between the SCF 22 and the coloring agent component 20 as well as the binding resin component 18)

Condition B. (The Coloring Agent Component 20 and the Binding Resin Component 18 are Precipitated, so that the Coloring agent Component 20 is Dispersed in the Binding Resin Component 18)

The affinity between the wax component and the SCF 22<(the affinity within the wax component, the affinity between the SCF 22 and the coloring agent component 20 as well as the binding resin component 18)<the affinities between the precipitated wax component and the coloring agent component 20 as well as the binding resin component 18<the affinity between the coloring agent component 20 and the binding resin component 18.

Condition C. (The Binding Resin Component 18, in which the Coloring agent Component 20 is Dispersed, is Precipitated on the Wax Component)

The affinity between the wax component and the SCF 22<(the affinity within the wax component, and the affinities between the SCF 22 and the coloring agent component 20 as well as the binding resin component 18)<the affinity between the coloring agent component 20 and the binding resin component 18<the affinity between the precipitated wax component and the binding resin component 18 in which the coloring agent component 20 is dispersed.

Note that, in the wax-core toner, the coloring agent component 20 may be placed at any position, for example, in between the wax component and the binding resin component 18, or in the wax component, by setting the foregoing affinities differently.

In the image forming method with the color toner, because a large quantity of the toner is used in general, it is common to apply silicon oil to improve the separation of the toner from the fixation section, in a step (a fixation step) where the thermally melted toner is fixed on a printing medium such as paper with pressure. The wax-core toner, however, eliminates the need of the oil application mechanism in the fixation section, thus contributing to the miniaturization of the apparatus.

Moreover, produced is a toner with the wax component dispersed uniformly in the binding resin component 18, by setting the solubility of the wax component to be changed in the same manner as those of the binding resin component 18 and the coloring agent component 20. Especially the monochrome toner is preferred to have a small quantity of the wax component, even though, compared to the color toner for the color image formation, the monochrome toner does not require a large quantity of oil. Conventionally, a small quantity of the wax component is added into the toner for obtaining the necessary characteristics.

However, the conventional toner has such a problem that the wax component is easily agglomerated, thus frequently causing poor dispersibility of the wax component that leads to inferior charge characteristics due to exposure of the agglomerated wax component, or improper thermal melting behavior of the toner due to instability in the wax component to be added. Therefore, a satisfactory image could not be obtained with the image forming apparatus using the above conventional toner.

On the other hand, the present invention can give good image quality by using the toner produced with highly uniform dispersion of the wax component by uniformly dissolving or dispersing the wax component in the SCF 22, and thus being free from the foregoing problems.

For the production of the wax-dispersed toner, it is preferred to carry out the precipitation with a sequence in which the wax component and the coloring agent component 20 are precipitated firstly, then the binding resin component 18 is done so secondly. Such manufacturing conditions are listed below as conditions d. and e.

Condition d. (The Wax Component and the Coloring Agent Component 20 are Precipitated)

The wax component and the coloring agent component 20 are precipitated. Here, it is preferred to prevent the wax component and the coloring agent component 20 from adhering with each other.

Condition e. (The Binding Resin Component 18 is Precipitated)

The binding resin component 18 is precipitated. The wax component and the coloring agent component 20 are dispersed in the binding resin component 18 for creating the toner particles. Here, the wax component and the coloring agent component 20 can be well dispersed in the binding resin component 18 by having greater affinity between the wax component and the binding resin component 18 than the affinity between the wax component and the coloring agent component 20.

Where the toner is manufactured in the conditions d. and e., the following condition D. and E. are set for the affinities between the SCF 22 as the reaction solvent including the entrainer 3 and the respective solutes, and within the respective solutes.

Condition D. (The Wax Component and the Coloring agent Component 20 are Precipitated)

The affinity between the wax component and the SCF 22, and the affinity between the coloring agent component 20 and the SCF 22<the affinity between the binding resin component 18 and the SCF 22.

Condition E. (The Binding resin Component 18 is Precipitated)

The affinity between the wax component and the SCF 22, and the affinity between the coloring agent component 20 and the SCF 22<the affinity between the binding resin component 18 and the SCF 22<the affinity between the coloring agent component 20 and the wax component<the affinities between the binding resin component 18 and the coloring agent component 20 as well as the wax component.

Moreover, the toner may be manufactured in such a manner that the SCF 22 is provided with a charge control agent component for adjusting the charge characteristics of the toner. The following substances may be used for the charge control agent component, for example: quaternary ammonium salts, nigrosine, amino compounds, and organic dyes. Especially, chromium metal complex dyes and alkali dyes and their salts are well-known as charge control agents, namely: benzyl dimethyl-hexadecyl ammonium chloride, decyl-trimethyl ammonium chloride, nigrosine salts, nigrosine hydrochloride, safranine γ, and crystal violet.

A toner with the charge control agent component concentrated on its surface is obtained by using the above method.

That is, by appropriately setting the affinity between the charge control agent component and the binding resin component 18, and the affinities between the coloring agent component 20 and the SCF 22 as well as the entrainer 3, the solubilities of the respective solute components are differed during the depressurizing step of the SCF 22 so that, for example, the affinity of the charge control agent component is the greatest. Then, the binding resin component 18 and the coloring agent component 20 are precipitated first in the depressurizing step for creating the particulate. Following this, the charge control agent component is precipitated on the surface of the particulate so as to produce the toner with the charge control agent component concentrated on its surface.

Because the charge of the toner generally depends on electric charge quantity near the surface of the toner, surface resistivity of the toner influences the charge state of the toner. The charge control agent component is added for controlling the surface resistivity of the toner. Since the charge control agent component is relatively expensive, the lower the charge control agent content per toner by unit weight, the cheaper the price of the toner with the charge control agent component.

For a toner as that of the present invention, in which the charge control agent component is concentrated in the vicinity of the surface of the toner, the charge control agent component, which is added in the toner, can work effectively for controlling the charge of the toner.

Moreover, the charge control agent component has a low probability of existing in the interior of the toner, where has a little effect on the charge control of the toner. Therefore, the charge control agent content per toner by unit weight can be reduced while maintaining the charge ability of the toner given by the charge control agent component, thus lowering the price of the toner.

Discussed below are how the affinities are set between the respective components and the SCF 22 for the production of the toner with the charge control agent component concentrated on its surface. To begin with, it is preferred that the precipitation has a sequence in which the coloring agent component 20 and the binding resin component 18 is precipitated firstly, then the charge control agent component is precipitated secondly. The precipitation is carried out by the expansion through depressurization in order to lower the solubilities of the solutes, and starts from the state in which all of the solute components are dissolved in the SCF 22. Listed below are such manufacturing conditions f. and g.

Condition f. (The Coloring Agent Component 20 and the Binding Resin component 18 are Precipitated)

The coloring agent component 20 and the binding resin component 18 are precipitated, so that the coloring agent component 20 is dispersed in the binding resin component 18.

Condition g. (The Charge Control Agent Component is Precipitated)

Consequently, the charge control agent component is precipitated, so that the charge control agent component is applied in the vicinity of the surface of the binding resin component 18 containing the coloring agent component 20. Note that, it is preferred that the affinity between the binding resin component 18 and the coloring agent component 20 is set to be the greatest, in order to maintain the dispersion of the coloring agent component 20 in the binding resin component 18.

When the toner is manufactured in the respective conditions f. and g., the following conditions F. and G. are set for the affinities between the respective solute components and the SCF 22 as the reaction solvent containing the entrainer 3, and within the respective solute components.

Condition F. (The Coloring Agent Component 20 and the Binding Resin Component 18 are Precipitated)

The affinities between the SCF 22 and the coloring agent component 20 as well as the binding resin component 18<the affinity between the charge control agent component and the SCF 22.

Condition G. (The Charge Control Agent Component is Precipitated)

The affinities between the SCF 22 and the solute components, namely, the coloring agent component 20, the binding resin component 18 and the charge control agent component<the affinity between the charge control agent component and the binding resin component 18<the affinity between the binding resin component 18 and the coloring agent component 20.

It should be noted that the conditions A. to E. are respectively and properly set as required when the wax component is included in the toner.

In addition, there are some combinations of the substances for the SCF 22, entrainer 3, the binding resin component 18, and the coloring agent component 20, which do not allow the solubility relationships between the respective substances during the depressurization of the SCF 22 as described above. In such cases, the charge control agent component and the resulting toner particles are introduced into a mixer and blended therein so that the charge control agent component is applied onto the surface of the toner particles, thereby producing the toner with the charge control agent component positioned in the vicinity of the surface of the toner. The toner produced in that manner can have the same effect as described previously.

Second Embodiment

Figure 6:
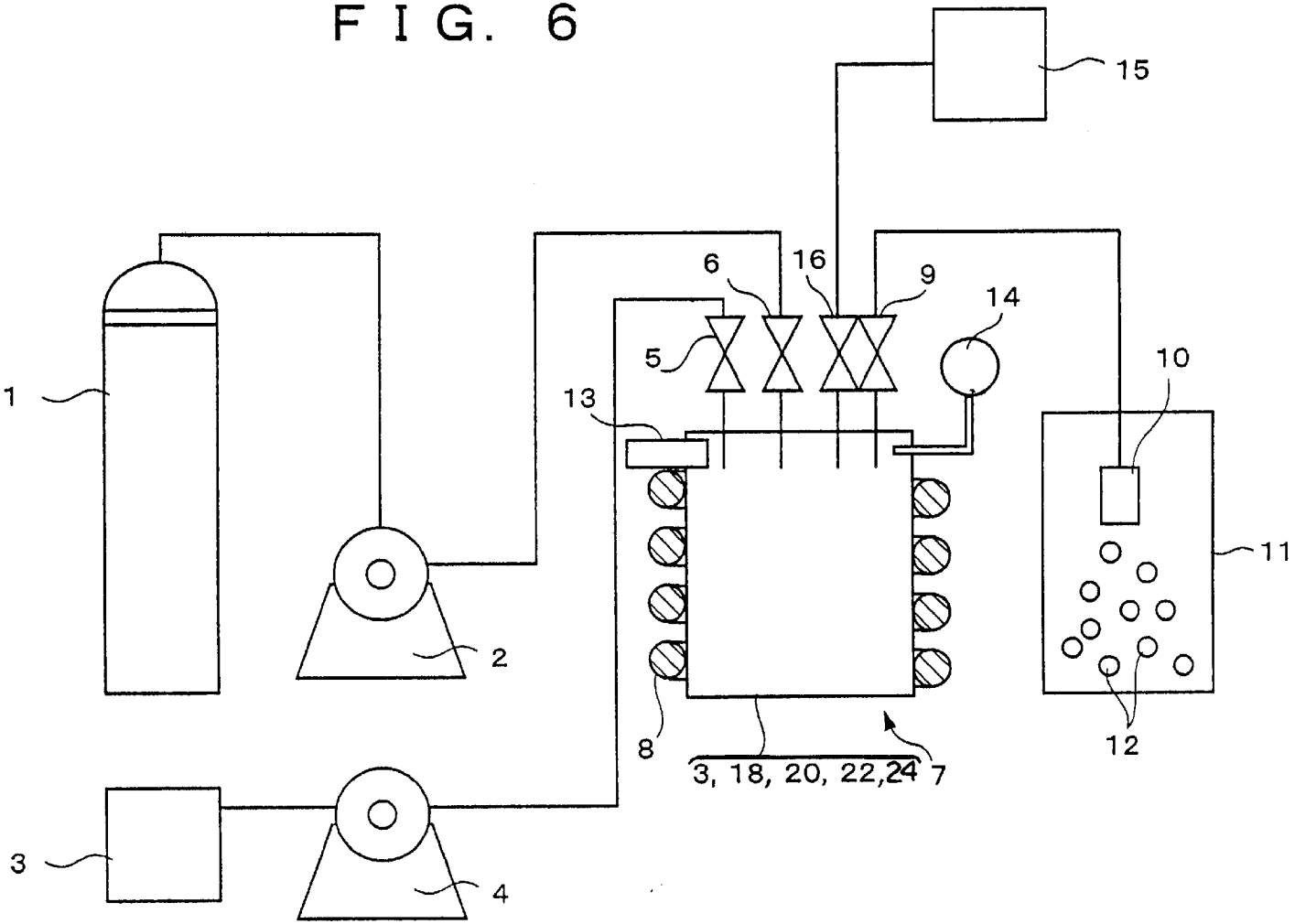
FIG. 6 is an explanatory view illustrating a structure of another toner manufacturing apparatus for producing the toner of the present invention.
Figure 7:
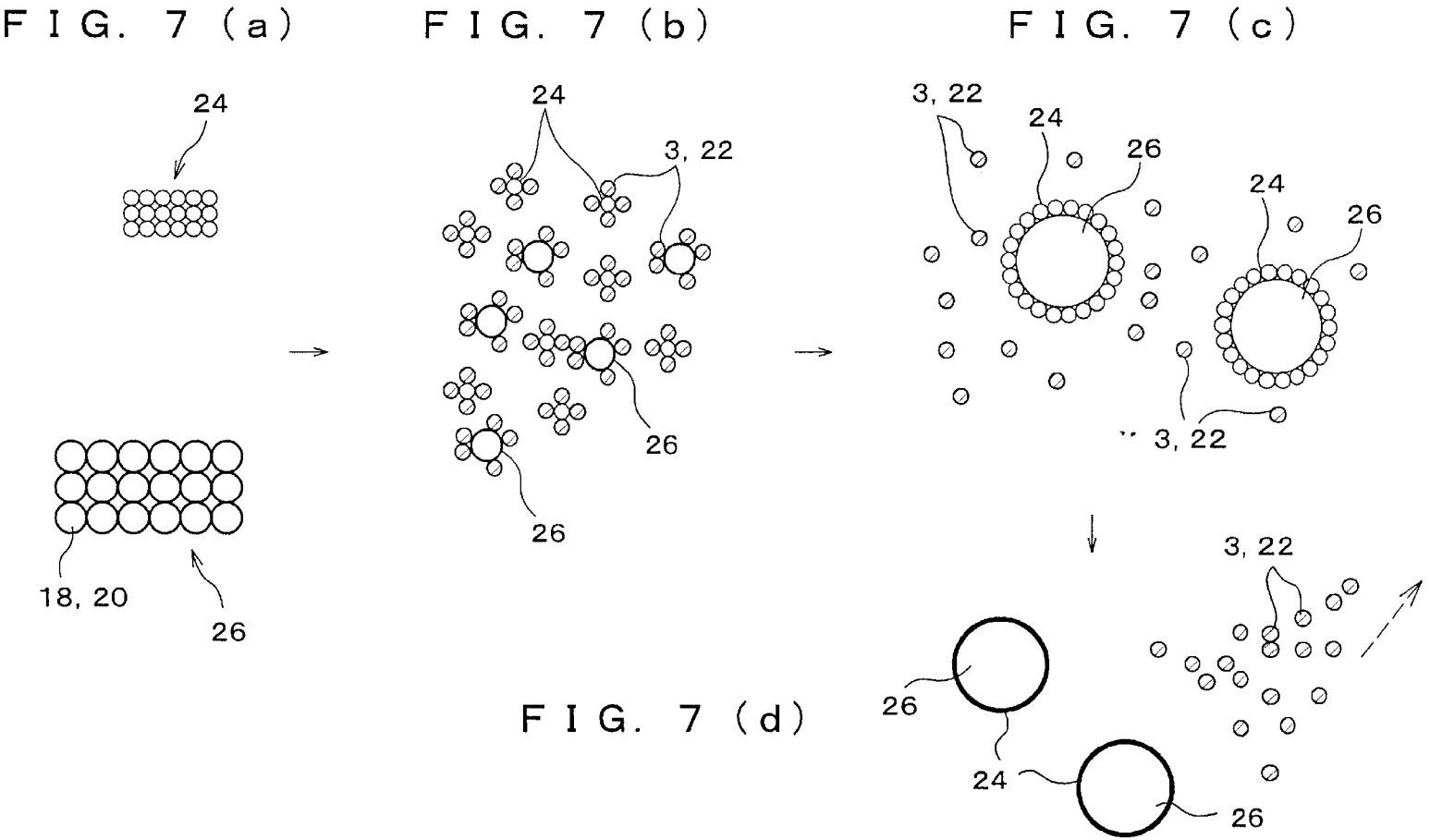
FIGS. 7(*a*) to 7(*d*) are a flow diagram schematically showing manufacturing steps of the toner.

As a toner of a second embodiment of the present invention, described herein is a toner with surface modification by a surface modifier component. Shown in FIG. 6 and FIG. 7 is an example of the toner having a surface modifier component 24, which has been dissolved, precipitated on the surface of a core-forming toner particle 26. Here, the core-forming toner particle 26 and the surface modifier component 24 to be applied on the surface of the toner are blended in a SCF 22 in a reactor 7 so that the surface modifier component 24 is dissolved in the SCF 22 while the core-forming toner particle 26 is dispersed in the SCF 22 by being broken down to its primary particle. Subsequently, the SCF 22 in the reactor 7 is depressurized in the foregoing fashion so that the dissolved surface modifier component 24 is precipitated on the surface of the core-forming toner particle 26.

The toner produced in the above manner has the core-forming toner particle 26 that includes the coloring agent component 20 in a large quantity and has the surface modifier component 24 for coating the surface of the core-forming toner particle 26. Therefore, prevented thereby is exposure of a large quantity of the coloring agent component 20 from the surface of the product toner, while mechanical strength of the toner is also improved by the coating by the surface modifier component 24.

The binding resin component 18 in the core-forming toner particle 26 may be used as the surface modifier component 24 as well, while it is more preferable, for manufacturing reasons, that the surface modifier component 24 is a different resin from the binding resin component 18 in the core-forming toner particle 26 because, in this way, less restrictions are imposed on conditions for dissolving only the surface modifier component 24 but not dissolving the core-forming toner particle 26.

Even when the resin component of the surface modifier component 24 and the binding resin component 18 in the core-forming toner particle 26 are made from substances of the same category, for instance, polyester resins (or acrylate resins), with differences in molecular weight, crystallinity or functional group, only the surface modifier component 24 can be dissolved without dissolving the core-forming toner particle 26 by setting the conditions (such as the choice of the substance for the SCF 22, the type of the entrainer 3, temperature and pressure conditions) to have different solubilities in the SCF 22. However, this imposes more restrictions on the conditions, and may lead to instability in the toner production.

Stable surface modification of the toner can be achieved and less restrictions are imposed on the manufacturing conditions by having different types of substances for the resin components of the surface modifier component 24 and the binding resin component 18 of the core-forming toner particle 26.

It is preferable that the core-forming toner particle 26 has a volumetric average particle diameter in the range from 3 $\mu$m to 7 $\mu$m. A core-forming toner particle 26 in a diameter less than 3 $\mu$m has a difficulty in being manufactured in the MKG method, while that in a diameter more than 7 $\mu$m causes inferior image at the image formation.

Moreover, for example, where the surface modifier component 24 is made from a resin with a high melting temperature and the binding resin component 18 in the core-forming toner particle 26 from a resin with a melting temperature lower than that of the resin component of the surface modifier component 24, the product surface-modified toner has, as a whole, a low melting temperature in fixation, whereas a hard-to-melt coating on the outer layer sider prevents the toner from being melted and fixed where the melting and fixing are undesirable. This provides a toner with separate functions Furthermore, it is preferred that the surface modifier component 24 has a good spectral transmittance in the visible light range so that a good coloring is achieved by the coloring agent component 20 in the core-forming toner particle 26, when the toner is melted in the fixation process. Especially for the color image output, where color overlapping is necessary for reproducing a secondary color or a tertiary color, it is required to prevent unnecessary light absorption by a binding resin as much as possible.

For better spectral transmittance in the visible light range, polyester resins or acrylate resins, which have good optical characteristics, are suitable for the resin component of the surface modifier component 24. The toner with surface modification by those materials does not hinder the coloring of the coloring agent component 20 in the toner when the toner is melted in the fixation process, thus creating high quality image.

The manufacturing steps of the surface-modified toner is discussed hereinafter, with reference to FIG. 6 and FIG. 7. To begin with, the resin component of the surface modifier component 24 is dissolved in the SCF 22 in the reactor 7 in which the surface modifier component 24 and the core-forming toner particle 26 are blended. The action of the entrainer 3 also helps the above dissolution of the surface modifier component 24.

This state is maintained for a predetermined time. Then, rapid expansion of the SCF 22 takes place in the reactor 7 by opening a depressurizing valve 9. Here, the solubility of the resin component of the solute dissolved in the SCF 22, in other words, of the surface modifier component 24 is reduced significantly, so that the resin component of the surface modifier component 24 as a solute is precipitated, thus the surface of the core-forming toner particle 26 is coated with the surface modifier component 24, to be a surface-modified toner 28. The surface-modified toner 28 is collected in a particle collector 11 via a nozzle 10.

Note that, the previously mentioned methods (introductions of a poor solvent or a surfactant) may be used instead of the rapid expansion for lowering the solubilities. Further, the surface-modified toner 28 produced in that manner may be coated with silica particulate and the like as a fluidity adjusting agent, as described earlier.

Moreover, the toner particulate 12 with a large quantity of the coloring agent component 20 may be used for the core-forming toner particle 26, but it is preferable to use a toner particle prepared in the conventional MKG method.

Conventionally, when a large quantity of coloring agent was added in a toner, there were cases where the coloring of the coloring agent may deteriorate due to poor dispersion of the coloring agent in the toner, on contrary. Use of the polymerization methods for producing the toner have a difficulty in improving the dispersibility of the coloring agent. For example, the suspension polymerization, which is the most common method among polymerization methods, has a difficulty in increasing the coloring agent content more than the current level, because the re-agglomeration of the coloring agent particles frequently occurs during polymerization even with the coloring agent uniformly dispersed in the raw materials (a mixture of monomers and coloring agents) beforehand.

On the other hand, in the conventional MKG method, a toner can be produced with targeted particle diameters by grinding a chip of a binding resin in which a coloring agent is blended via its melting and kneading processes. This gives the conventional MKG method an advantage over the polymerization methods in terms of the dispersion of the coloring agent, because the large sharing force at the melting and the kneading processes and the rapid cooling after kneading process can prevent the coloring agent particles from re-agglomeration.

On the other hand, the MKG method gives the product toner of a structure with a large number of coloring agent particles exposed from the surface of the toner, due to its grinding process for creating the toner. This has an adverse effect on the electric characteristics (the charge characteristics) of the product toner. Furthermore, it is a disadvantage of the conventional MKG method that its grinding process often gives the product toner a particle diameter smaller than the targeted diameters when the coloring agent content is increased to a large extent, because of the mechanically weak interface between the coloring agent and the binding resin.

However, such drawbacks can be overcome by the surface-modified toner which is produced by application of the surface modification method of the present invention to the toner produced in the conventional MKG method. This makes the toner, which is produced by the conventional MKG method, preferable for the core-forming toner particle 26, because of the easy operation of the conventional method.

In this case, the surface modification can at least maintain the coloring power of the surface-modified toner of the present invention even when the quantity of the coloring agent component 20 in the core-forming toner particle 26 is increased more than the conventional level, thus promoting the miniaturization of the image forming apparatus using the toner. In addition, the conventional MKG method, being a dry method, requires no washing/drying process, just like the surface modification method of the present invention. This contributes to the cost reduction of the toner production.

The surface-modified toner may include the mold releasing agent (wax) component in the toner produced by the conventional MKG method.

As discussed previously, the simple addition of a large quantity of the wax component in the toner produced by the conventional MKG method can eliminate the need of the oil application means at the fixation section in the image forming apparatus, thus promoting the miniaturization of the apparatus. In this case, however, the wax component is exposed from the surface of the toner, and may be melted during operation, so that the toner may adhere onto improper parts in the image forming apparatus.

On the other hand, the application of the surface modification of the present invention to such toner can prevent such a drawback, while the need of the oil application means is also eliminated, thereby promoting the miniaturization of the image forming apparatus.

In addition, realization of a toner with low melting point has been attempted for giving a energy saving feature to the image forming apparatus. In the attempt, the wax component was added in the binding resin component 18 for lowering the melting point of the toner. If a large quantity of the wax was exposed from the surface of the toner, the same problem might be caused. The surface modification method of the present invention may be employed in manufacture of such toner for good image formation.

The following describes the present invention based on concrete examples. It should be noted that the respective examples do not limit the scope of the present invention.

EXAMPLE 1

The toner manufacturing apparatus as shown in FIG. 1 was used for producing the toner of a present example 1. The volumetric capacity of the reactor 7 was 1000 $cm^3$, for example. Carbon dioxide was used for the gas as the SCF 22 in the present example 1, while Methanol (a common reagent sold on the market) was used for the entrainer 3.

For the binding resin component 18, a polyester resin (provided by Sanyo Chemical Industries Co., Ltd., Product Name: EP 208) was used by 50 g. Carbon Black (provided by Mitsubishi Chemical Co., Ltd., Product Name: MA 100) as the coloring agent component 20 was added in the reactor 7 in advance by 10% to 30% by weight with respect to 100% by weight of the polyester resin. Note that, the entrainer 3 was incompatible with the binding resin component 18 at ordinary temperature and ordinary pressure.

The carbon dioxide gas supplied from the gas cylinder 1 was pressurized by the pressurizing pump 2, then was introduced into the reactor 7 via the valve 6. 200 $m^3$ of the methanol, as the entrainer 3, was also introduced into the reactor 7 via the pressurizing pump 4.

At this stage, the depressurizing valve 9 for discharging was still closed. Thus, the introduction of the pressurized carbon dioxide increased the pressure in the reactor 7. Meanwhile, the temperature in the reactor 7 was adjusted by the heater 8, in the present example 1, to be 320K.

Inside the reactor 7 becomes supercritical when a pressure of 7.3 MPa or higher is achieved in the reactor 7. In the present example 1, the pressure in the reactor 7 was adjusted to 20 MPa by adjusting the valves 5 and 6, respectively, for having a state where at least the binding resin component 18 was dissolved in the reactor 7.

After keeping this state, for example, for a 20-minute period, the depressurizing valve 9 was opened to discharge the mixed solution from the reactor 7 into the particle collector 11 via the nozzle 10. This caused rapid expansion, obtaining the toner particulate 12. The toner particulate 12, which was composed of the binding resin component 18 precipitated in a semi-spherical shape with the coloring agent component 20 almost uniformly dispersed therein, was deposited and collected in the particle collector 11. Here, the carbon dioxide as the SCF 22 and the methanol as the entrainer 3 were recovered by recovering means (not shown) , and isolated by fractional means (not shown) from each other for recycling purposes.

In the present example 1, the agglomeration of the toner particulate 12 (in other words, the bonding between themselves) was prevented by the use of the entrainer 3 incompatible with the binding resin component 18 at ordinary temperature and ordinary pressure, even if a trace of the entrainer 3 was adhering on the surface of the thus-obtained toner particulate 12. This maintains the fineness of the toner particulate 12. Subsequently, 0.1% by weight of silica (provided by Nihon Aerosil Co., Ltd., Product Name: R972) covered on the surface of the toner particulate 12 by a well-known method (for example, by a dry mixer) for adjusting the fluidity. Then, the toner, the final product, was obtained.

Even a small quantity of the thus produced toner, having a large quantity of the coloring agent component 20 with excellent dispersibility of the coloring agent component 20, could give a desirable printing density. Thus, compared to the conventional toner, the same number of pages could be printed out with much less toner consumption (less by several fold) when the thus produced toner was used. Therefore, a user-friendly and miniaturized image forming apparatus can be provided without shortening a toner exchange cycle.

When the toner is produced in high concentration (as high as in the present example 1) of the coloring agent component 20 by conventional methods such as the well-known MKG method, resulted is inferior image formation which is caused by fog generation or more instability in degree of toner charge depending on usage environment.

Moreover, the conventional methods has problems, such as generation of excessively-fine powders or a change in particle-diameter distribution due to the toner particles crushed down after a long usage, the problems leading to an inferior image quality. The problems, however, can be prevented in the toner of the present invention, thus good image formation is provided stably obtained by the toner of the present invention.

EXAMPLE 2

While the example 1 used the binding resin component 18 prepared from the raw material that was already in a resin (a polymer) form, it is also possible to use monomers for the raw material of the binding resin component 18, as described below, for producing the toner of the present invention.

In a present example 2, polymethyl methacrylate (PMMA) was selected to be the binding resin component 18. Thus, 50 g of methyl methacrylate monomer was added as a raw material of the PMMA in the reactor 7. Also added was azobis-isobutyl nitrile (AIBN) in about 1% by weight as a polymerization initiator. As in the above case, pressurized carbon dioxide was introduced into the reactor 7, to create a first supercritical state. Here, the conditions in the reactor 7 were set as follows: the temperature was in the range from 330K to 340K, the pressure was at about 20 MPa.

The state was maintained for one to two hours. The polymerization was carried out in the first supercritical state for obtaining the PMMA as the targeted binding resin component 18 in a form dissolved in the SCF 22.

After that, the coloring agent component 20 as stated in the example 1 was introduced into the reactor 7, and a second supercritical state was created with a temperature of 320K and a pressure of 20 MPa in the reactor 7. Then, the toner was produced in the same fashion as the example 1. The toner showed the same effects as the example 1.

EXAMPLE 3

When a color toner of the present invention is produced, the respective pigments, which were previously named in the embodiment section of the present invention, may be used for the coloring agent component 20. In a present example 3, a toner with magenta color is discussed, for exemplification. The present example 3 employed the same manufacturing apparatus and method as the example 1 for producing the color toner, except that carmin 6B (a pigment) was used for the coloring agent component 20, in a quantity in the range between 10% and 30% by weight.

Here, the coloring agent component 20 could be provided in the form of a masterbatch, in which pigments were dispersed in the binding resin component 18 in high concentration. The quantity of masterbatch to be added was set so that the quantity of the coloring agent component 20 was in the range between 10% and 30% by weight. In addition, the resin component of the masterbatch was preferred to be the same resin as the binding resin component 18. In this way, there will be no increase in parameter for setting a solubility of the masterbatch with respect to the mixture of the SCF 22 and the entrainer 3, thus making toner production easier.

The rest of the procedure was carried out in the same manner as the example 1 or 2 for producing the toner. In addition, the respective previously-listed pigments are used as the coloring agent component 20 to be blended in for producing a toner with cyan or yellow colors. The toner of the example 3 showed the same effects as discussed in the example 1. Moreover, the toner was effective for further miniaturization of the color image apparatus.

EXAMPLE 4

In the examples 1 to 3, a mold releasing agent (wax) component may be added as a material to be introduced into the reactor 7. In a present example 4, added as the wax component were polypropylene (provided by Sanyo Chemical Co., Ltd., Product Name: 550P) and polyethylene (provided by Hoechst Japan Co., Ltd., Product Name: PE130), in quantities of 2% and 1,5% by weight, respectively, with respect to 100% by weight of the binding resin component 18. With the respective substances prepared in the reactor 7, the toner was manufactured in the same manner as the examples 1 to 3. The toner of the present example 4 showed not only the same effects as discussed in the example 1, but also good fixing characteristics by the addition of the wax component.

EXAMPLE 5

In the examples 1 to 4, a charge control agent component may be added as a substance to be introduced into the reactor 7. In a present example 5, used as the charge control agent component was a chromium metal complex dye (provided by Orient Chemical Co., Ltd., Product Name: BONTRON S-34), in a quantity of 1% by weight with respect to 100% by weigh of the binding resin component 18. With the respective substances prepared as described above in the reactor 7, the toner was manufactured in the same manner as the examples 1 to 4.

The toner of the present example 5 also showed the same effects as those of the examples 1 to 4. Further, the toner of the present example 5 not only showed better charge characteristics, but also achieved the charge characteristics with a small quantity of the charge control agent, thus being effective for the cost reduction of the toner. This can provide the image forming apparatus with a low running cost.

EXAMPLE 6

In the examples 1 to 4, the thus prepared toner particulate 12 without coating on its surface was taken out of the particle collector 11 for coating with a charge control agent on its surface by a dry mixer such as a Henshel mixer.

The toner of a present example 6 showed the same effects as the examples 1 to 4. Moreover, the toner of the present example 6 not only had better charge characteristics, but also achieved the charge characteristics with a small quantity of the charge control agent, thus being effective for the cost reduction of the toner. This can provide the image forming apparatus with a low running cost. Furthermore, with the toner of the present example 6, less restrictions are imposed on the toner manufacturing conditions, thus enabling a supply of a toner with constant quality.

EXAMPLE 7

The toner manufacturing apparatus as shown in FIG. 1 was used for producing the toner of a present example 7. The volumetric capacity of the reactor 7 was 1000 $cm^3$ for example. Carbon dioxide was used for the gas as the SCF 22 in the present example 7, while Methanol (a common reagent sold on the market) was used for the entrainer 3.

For the core-forming toner particle 26, a styrene-acrylic resin (provided by Sekisui Chemical Co., Ltd., Product Name: Esrek P598) was used as the binding resin component 18, while Carbon Black (provided by Mitsubishi Chemical Co., Ltd., Product Name: MA 100) was added as the coloring agent component 20, to be 20% by weight. The core-forming toner particle 26 was produced by the well-known MKG method with a volumetric average particle diameter of about 5 $\mu$m.

50 g of the core-forming toner particle 26 and 5 g of a polyester resin as the resin component of the surface modifier component 24 were added in the reactor 7 in advance. Note that, the entrainer 3 was incompatible with the binding resin component 18 and the resin component of the surface modifier component 24 at ordinary temperature and ordinary pressure.

The carbon dioxide gas supplied from the gas cylinder 1 was pressurized by the pressurizing pump 2, then was introduced into the reactor 7 via the valve 6. 200 $m^3$ of the methanol, the entrainer 3, was also introduced into the reactor 7 via the pressurizing pump 4.

At this stage, the depressurizing valve 9 for discharging was still closed. Thus, the introduction of the pressurized carbon dioxide increased the pressure in the reactor 7. Meanwhile, the temperature in the reactor 7 was adjusted by the heater 8, in the present example 7, to be 320 K.

Inside the reactor 7 becomes supercritical when a pressure higher than 7.3 MPa is achieved in the reactor 7. In the present example 7, the pressure in the reactor 7 was set to 20 MPa by adjusting the valves 5 and 6, respectively, for having a state where at least the resin component of the surface modifier component 24 was dissolved in the SCF 22 in the reactor 7.

After keeping this state, for example, for a 20-minute period, the depressurizing valve 9 was opened to discharge the mixed solution from the reactor 7 into the particle collector 11 via the nozzle 10. This caused rapid expansion, so that the surface modifier component 24 was precipitated on the surface of the core-forming toner particle 26. The resultant was deposited and collected in the particle collector 11.

Here, the carbon dioxide as the SCF 22 and the methanol as the entrainer 3 were recovered by recovering means (not shown), and isolated by fractional means (not shown) from each other for recycling purposes.

In the present example 7, the agglomeration of the toner particulate (in other words, the bonding between themselves) was prevented by the use of the entrainer 3 incompatible with the resin component of the surface modifier component 24 at ordinary temperature and ordinary pressure, even if a trace of the entrainer 3 was adhering on the surface of the obtained surface-modified toner particulate. This maintained the fineness of the toner particulate. Subsequently, 0.1% by weight of silica (provided by Nihon Aerosol Co., Ltd., Product Name: R972) covered on the surface of the toner particulate 12 by a well-known method (for example, by a dry mixer) for adjusting the fluidity. Then, the toner, a final product, was obtained.

Even a small quantity of the thus produced toner, having a large quantity of the coloring agent component 20 with excellent dispersibility of the coloring agent component 20, could give a desirable printing density. Thus, compared to the conventional toner, the same number of pages could be printed out with much less toner consumption (less by several fold) when the thus produced toner was used. Therefore, a user-friendly and miniaturized image forming apparatus can be provided without shortening a toner exchange cycle.

When the toner (before surface modification) is produced in high concentration (as much as in the present example 7) of the coloring agent component 20 by conventional methods such as the well-known MKG method, resulted is inferior image formation which is caused by fog generation or more instability in degree of toner charge depending on usage environment.

Moreover, the conventional methods has problems, such as generation of excessively-fine powders or a change in particle-diameter distribution due to the toner particles crushed down after a long usage, the problems leading to an inferior image quality. The problems, however, can be prevented by the toner of the present invention with surface modification by the surface modifier component 24, thus stably obtaining good image formation.

EXAMPLE 8

While the example 7 used the resin component of the surface modifier component 24 prepared from the raw material that was already in a resin (a polymer) form, it is also possible to use monomer for the raw material of the resin component, as described below, for producing the surface modified toner of the present invention.

In a present example 8, used was a manufacturing apparatus in an arrangement shown in FIG. 6. polymethyl methacrylate (PMMA) was used for the resin component of the surface modifier component 24. Thus, 50 g of methyl methacrylate monomer was added as a raw material of the PMMA in the reactor 7. Also added was azobis-isobutyl nitrile (AIBN) in about 1% by weight as a polymerization initiator. As in the above case, pressurized carbon dioxide was introduced into the reactor 7, to create a first supercritical state. Here, the conditions in the reactor 7 were set as follows: the temperature was in the range from 330K to 340K, the pressure was at about 20 MPa.

The state was maintained for one to two hours. The polymerization was carried out in the first supercritical state for obtaining the PMMA as the targeted resin component of the surface modifier component 24 in a form dissolved in the SCF 22. In this case, the resin component of the surface modifier component 24 was not produced in the particle collector 11, but in the reactor 7.

After that, the core-forming toner particle 26 as stated in the example 7 was introduced into the reactor 7 from a core-forming toner particle holder 15 via a valve 16, and a second supercritical state was created at a temperature of 320K and a pressure of 20 MPa in the reactor 7. Then, the toner was produced in the same fashion as the example 7. The toner showed the same effects as the example 7.

EXAMPLE 9

When a color toner of the present invention in accordance with the examples 7 and 8 is produced, the respective pigments, which were previously named in the embodiment section, may be used as the coloring agent component 20. In a present example 9, a toner with magenta color was used, for exemplification. The present example 9 employed the same manufacturing apparatus and method as the example 7 for producing the color toner, except that carmin 6B (a pigment) was used as the coloring agent component 20, in the quantity of 20% by weight.

The rest of the procedure was carried out in the same manner as the example 7 or 8 for producing the toner. In addition, the respective previously-listed pigments are used as the coloring agent component 20 to be blended in for producing a toner with cyan or yellow colors. The toner of the example 9 showed the same effects as discussed in the example 7. Moreover, the toner was effective for further miniaturizing the color image apparatus.

Furthermore, use of a polyester resin as the resin component of the surface modifier component 24 could give good image formation without deteriorating the coloring of the coloring agent component 20, in the color toner of the example 9 of the present invention. Use of an acrylic resin as the resin component could also give good image formation, similarly.

Even a small quantity of the thus produced toner could obtain spectral transmittance characteristics equivalent to those of the conventional toner, as shown in FIG. 3 by a thick line ⑤ (toner content: 0.3 mg/cm$^2$, coloring agent content: 20% by weight).

The toner with a surface modifier of poor spectral transmittance characteristics in the visible light range (toner content: 0.3 mg/cm$^2$ coloring agent content: 20% by eight), which was for comparison, showed an increase in unnecessary absorption in the wavelength range where high transmission is desired, as shown in FIG. 3 by thick broken line ⑥.

Therefore, as in the present example 9, the surface modifier component 24, which is made from a resin (such as polyester resins or acrylic resins) with good spectral transmittance characteristics in the visible light range, can give desirable spectral transmittance characteristics, thus offering a toner for good image formation.

The spectral transmittance characteristics were measured by the following measurement method. First, the toner in a predetermined quantity was applied on a transparent plate such as a glass plate to form a thin layer. The thin layer of the toner on the glass plate was heated for melting the toner so that a sample with a toner layer was prepared. The sample was set on a spectrometer, which is on the market, for measuring the spectral transmittance in order to obtain the spectral transmittance characteristics of the toner.

EXAMPLE 10

In the examples 7 to 9, a mold releasing agent (wax) component may be added in the core-forming particle 26. In a present example 10, added as the wax component were polypropylene (provided by Sanyo Chemical Co., Ltd., Product Name: 550P) and polyethylene (provided by Hoechst Japan Co., Ltd., Product Name: PE130), in quantities of 2% and 1,5% by weight, respectively, with respect to 100% by weight of the core-forming toner particle 26. With the core-forming toner particle 26 prepared as above, the toner was manufactured in the same manner as the examples 7 to 9. The toner of the present example 10 showed the same effects as discussed in the examples 7 to 9 without the problems caused by the exposure of a large quantity of the wax component on the surface, thus lowering the fixation temperature of the toner. Furthermore, the oil application means in the fixation section of the image forming apparatus can be eliminated by increasing the wax content in the core-forming toner particle 26, thus contributing to the miniaturization of the image forming apparatus.

Figure 8:
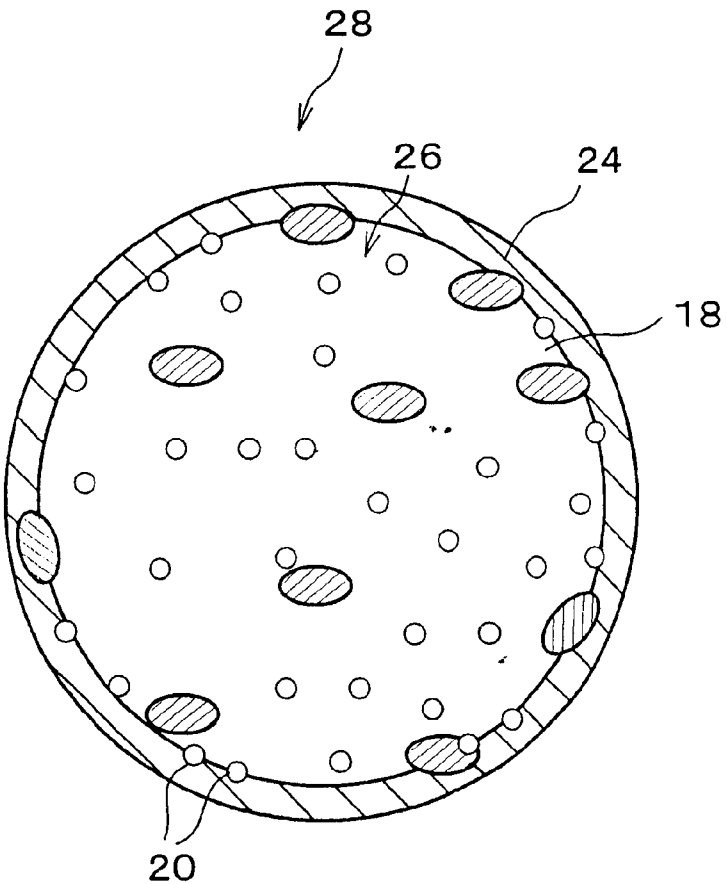
FIG. 8(*a*) is an explanatory view of a toner in an example 10 of the present invention, illustrating the toner without coating by a surface modifier component.
Figure 8:
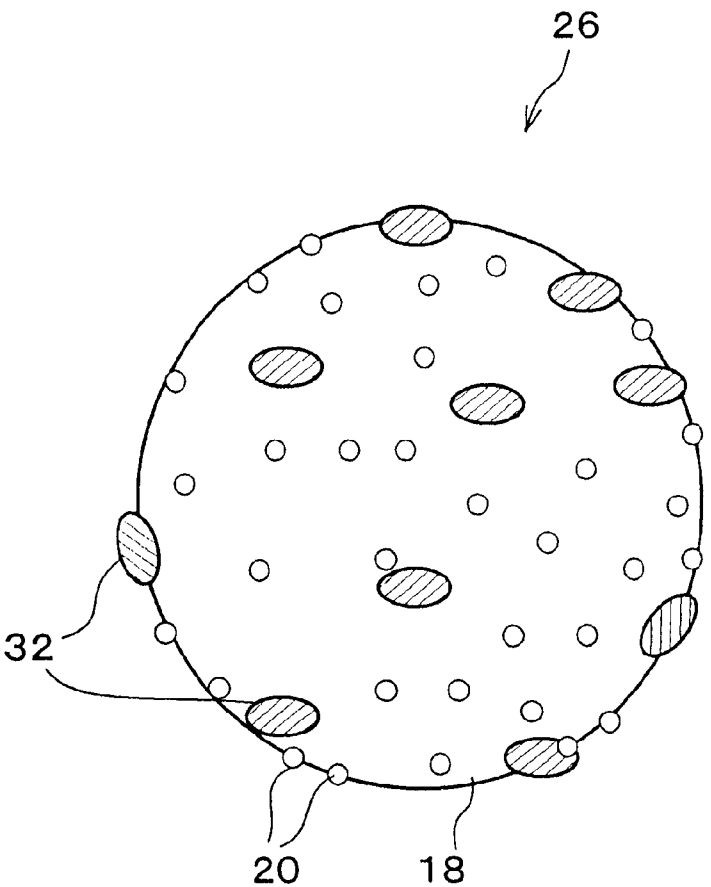

As shown in FIG. 8, the core-forming toner particle 26 before surface modification has a structure in which some of the coloring agent component 20 and wax component 32 is exposed from the surface of the binding resin component 18 of a particle shape, as shown in FIG. 8(*a*). On the other hand, the surface-modified toner 28 in the present example 10 had a structure where the coloring agent component 20 and the wax component 32 exposed from the surface of the binding resin component 18 were covered with the surface modifier component 24, as shown in FIG. 8(*b*), thereby preventing their exposure to the exterior.

EXAMPLE 11

In the examples 7 to 10, a charge control agent component may be added as a substance to be introduced into the reactor 7. In a present example 11, used as the charge control agent component was a chromium metal complex dye (provided by Orient Chemical Co., Ltd., Product Name: BONTRON S-34), in a quantity of 1% by weight with respect to 100% by weight of the resin component of the surface modifier component 24. With the respective substances prepared as described above in the reactor 7, the toner was manufactured in the same manner as the examples 7 to 10.

The toner of the present example 11 also showed the same effects as those of the examples 7 to 10. Further, the toner of the present example 11 not only showed better charge characteristics, but also achieved the charge characteristics with a small quantity of the charge control agent, thus being effective for the cost reduction of the toner. This can provide the image forming apparatus with a low running cost.

Figure 9:
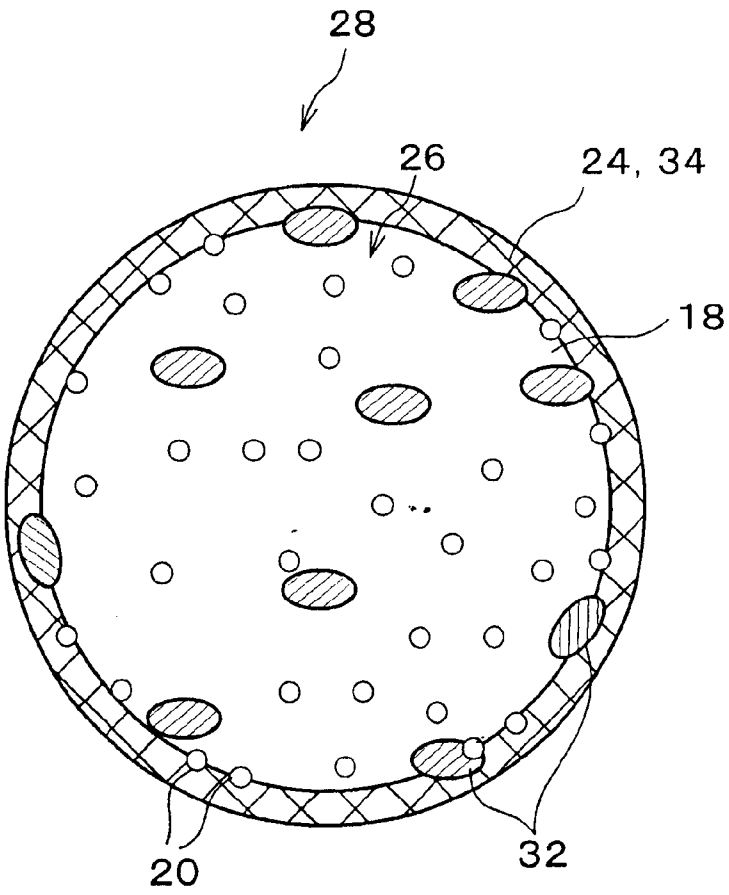
FIG. 9(*a*) is an explanatory view of a toner in an example 11 of the present invention, illustrating the toner without coating by the surface modifier component.
Figure 9:
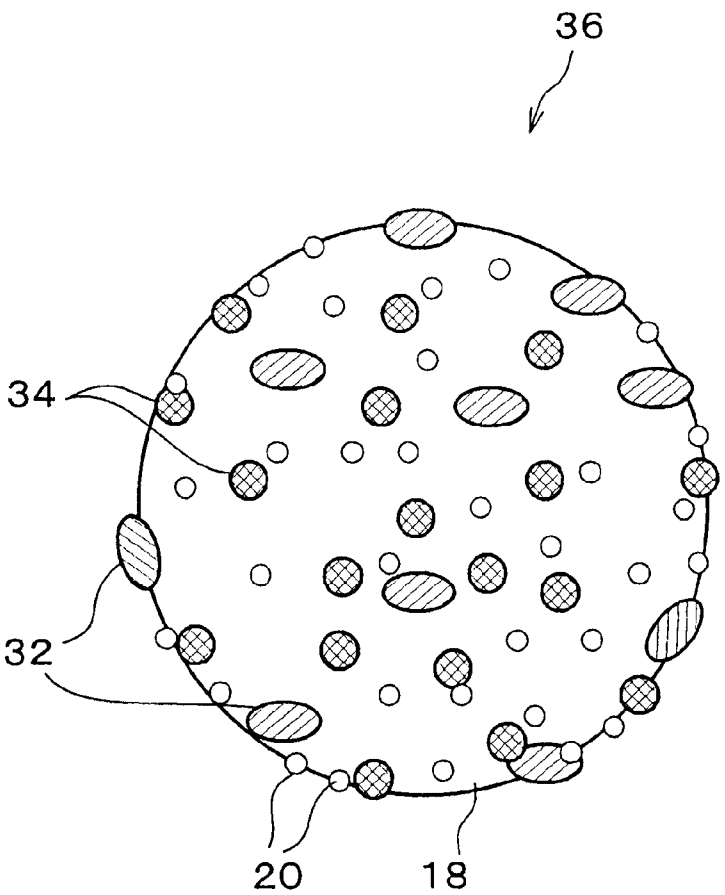

In a toner 36, which was manufactured by a conventional method such as the MKG method with a charge control agent component 34, some of coloring agent component 20 and the wax component 32 was exposed from the surface of the binding resin component 18 of a particle shape, while the charge control agent component 34 was dispersed not only in the vicinity of the surface of the binding resin component 18, but also interior of the binding resin component 18, as shown in FIG. 9(*a*).

On the other hand, in the surface-modified toner 28 of the present example 11, the coloring agent component 20 and the wax component 32, which were exposed from the surface of the binding resin component 18, were covered with the surface modifier component 24, thereby preventing their exposure to the exterior, while the charge control agent component 34 was concentrated, together with the surface modifier component 24, in the vicinity of the surface of the surface-modified toner 28, as shown in FIG. 9(*b*).

EXAMPLE 12

In the examples 7 to 10, the thus-prepared surface-modified toner before being coated on its surface was taken out of the particle collector 11 for coating a charge control agent on its surface by a dry mixer such as a Henshel mixer.

The toner of a present example 12 showed the same effects as the examples 7 to 10. Moreover, the toner of the present example 12 not only showed better charge characteristics, but also achieved the charge characteristics with a small quantity of the charge control agent, thus being effective for the cost reduction of the toner. This can provide the image forming apparatus with a low running cost. Furthermore, with the toner of the present example 12, lower restrictions are imposed on the toner manufacturing conditions, thus enabling a supply of a toner with constant quality.

A toner manufacturing method of the present invention, as described above, includes the steps for (a) dissolving a binding resin component in a supercritical fluid so that the binding resin component is blended with a coloring agent component, and (b) lowering solubility of the binding resin component in the supercritical fluid so that the binding resin component is precipitated in particle shapes with the coloring agent component dispersed in interior of the binding resin component.

With this method, by the steps of at least (a) dissolving a binding resin component in a SCF so that the binding resin component is blended with a coloring agent component, and subsequently (b) lowering solubility of the binding resin component so that the binding resin component is precipitated in particle shapes, it is possible to produce a toner with the coloring agent component dispersed in interior of the binding resin component precipitated in the particle shapes.

Here, blending the coloring agent component in the SCF can give greater dispersibility because of a large dispersion coefficient of the SCF, while can also prevent agglomeration of the coloring agent component, thereby improving the dispersibility of the coloring agent component in the binding resin component precipitated.

This maintains good image formation in the above method, because the good dispersibility of the coloring agent component avoids conventional problems such as reduction of coloring power or unstable charge characteristics of the toner by excessive exposure of the coloring agent component, even with an increase in the coloring agent content.

Moreover, in the above method, the quantity of the toner used can be reduced with an increase in the coloring agent content, thereby promoting miniaturization of an image forming apparatus with the toner.

Furthermore, manufacturing time of the toner can be shortened in the above method than in the conventional methods by the toner production that employs dissolution and precipitation of the binding resin component in the SCF, which changes the solubility of the binding resin component in the SCF. Therefore, energy and production cost for the toner production can be reduced in the above method than in the conventional polymerizing methods or the MKG method, because the precipitation of the binding resin component can be carried out in a short time in the above method.

Another toner manufacturing method of the present invention, as described previously, includes the steps for (1) polymerizing one or more types of monomers as a raw material of a binding resin component in a first SCF so that the binding resin component, which is a polymer, is produced, subsequently, (2) dissolving the binding resin component in a second SCF so that the binding resin component is blended with a coloring agent component, and (3) lowering solubility of the binding resin component in the second SCF so that the binding resin component is precipitated in particle shapes with the coloring agent component dispersed in interior of the binding resin component.

The above method can further reduce the production cost of the toner with a lower manufacturing cost of the binding resin component by preparing the binding resin component by polymerization in the SCF.

It is preferable in the foregoing manufacturing method that the solubility of the binding resin component is lowered in the SCF by rapid expansion, poor solvent introduction, or surfactant introduction. The above method can stabilize the toner production by ensuring reduction in the solubility of the binding resin component in the SCF.

In the foregoing manufacturing method, a mold releasing agent (wax) component may be added into the SCF. The above method can provide a wax-core toner by including the mold releasing agent (wax) component as a raw material to add in the SCF and precipitating the dissolved mold releasing agent (wax) component before the precipitation of the dissolved binding resin component and coloring agent component.

The wax-core toner eliminates the need of oil application means at the fixation section in the image forming apparatus that has been necessary in the conventional methods, thus contributing to the miniaturization of the image forming apparatus.

Furthermore, in the above method, a toner with the mold releasing agent (wax) component uniformly dispersed in the binding resin component can be produced by almost simultaneous precipitation of the mold releasing agent (wax) component and the binding resin component dissolved in the SCF. Therefore, characteristics of the toner, such as the toner charge characteristics and toner's behavior during melting process, can be stabilized because insufficient dispersion and agglomeration of the mold releasing agent (wax) component can be avoided in the above method. Thus, a good image quality can be obtained when the toner is used for the image formation.

In the above toner manufacturing method, it is preferred at least one or more types of solvents incompatible with the binding resin component at ordinary temperature and at ordinary pressure are blended into the SCF or the sub-SCF.

The above method can prevent the agglomeration (merging) of the thus produced toners by the presence of the solvent, which is incompatible with the binding resin component at ordinary temperature and ordinary pressure, between the toners which are prepared at ordinary temperature and ordinary pressure. Therefore, the toner with the targeted particle diameters can be obtained stably. This can eliminate the needs of post-process, such as re-grinding or classification of the toner after the toner production, thus cutting the manufacturing cost of toner.

A still another toner manufacturing method, as described above, includes the steps of (a) dissolving a surface modifier component for a core-forming toner particle, which includes a binding resin component and a coloring agent component, in a SCF so that the surface modifier component is blended with the core-forming toner particle, and (b) lowering solubility of the surface modifier component in the SCF so that the surface modifier component is precipitated on the surface of the core-forming toner particle.

With the above method, even a toner, which has a high coloring power obtained by including a large quantity of the coloring agent component in the core-forming toner particle, can reduce the exposure of the coloring agent component from the surface of the thus produced toner by being coated with the surface modifier component. This prevents the deterioration in the toner charge characteristics due to excessive exposure of the coloring agent component from the surface of the thus produced toner, thus providing a toner with good charge characteristics.

Moreover, with the above method, the mechanical strength of the toner can be also improved by coating the surface of the toner with the surface modifier component, thereby reducing the occurrence that the toner is crushed down after a long usage.

As a result, in the above method, use of the thus produced toner can reduce the energy and cost of the toner production, as well as can stabilize the image formation.

In the toner manufacturing method, the surface modifier component for the core-forming toner particle including the binding resin component and the coloring agent component may be prepared by polymerization in the SCF. In other words, the above method may include the steps of (a) polymerizing one or more types of monomers as raw materials of a surface modifier component in a first SCF so that the surface modifier component, which is a polymer, is produced, subsequently, (b) dissolving the surface modifier component in a second SCF so that the surface modifier component is blended with the core-forming toner particle, and (c) lowering solubility of the surface modifier component in the second SCF so that the surface modifier component is precipitated on the surface of the core-forming toner particle.

The above method can further reduce the cost for manufacturing the binding resin component with the surface modifier component produced by polymerization in the first SCF, thus cutting the production cost of the toner.

In the toner manufacturing method, it is preferred that the solubility of the surface modifier component is lowered in the SCF by rapid expansion, poor solvent introduction, or surfactant introduction. The above method can lower the solubility of the surface modifier component in the SCF with certainty, thereby stabilizing the toner production.

In the toner manufacturing method, it is preferred that the core-forming toner particle is prepared by a method (MKG method) involving melting, kneading, and grinding processes. The above method can have a good dispersibility of the coloring agent component by the MKG method even when the core-forming toner particle has a large quantity of the coloring agent component, thereby increasing the coloring power of the thus produced toner. Meanwhile, prevented is the deterioration of the toner charge characteristics due to exposure of the coloring agent component, because the coloring agent component exposed from the surface of the core-forming toner particle is also coated with the surface modifier component.

Because of those, the above method has advantages for miniaturizing the image forming apparatus using the toner, because of a larger quantity of the coloring agent with the coloring power of the toner maintained. Further, the MKG method itself does not require the washing/drying process, as in the case of the surface modifier component preparation, thereby contributing to the cost reduction in the toner production.

In the toner manufacturing method, the core-forming toner particle may include a mold releasing agent (wax) component. In the above method, use of the core-forming toner particle with the mold releasing agent (wax) component can eliminate the need of the oil application means, which is conventionally required, from the fixation section in the image forming apparatus, thereby contributing to the miniaturization of the image forming apparatus using the toner. Moreover, the above method can contribute to energy-saving during the fixation process of the image forming apparatus using the toner, by including a mold releasing agent (wax) component that can lower the melting point of the thus produced toner.

Furthermore, in the above method, the coating with the surface modifier component can solve the conventional problems caused by the exposure of the added releasing agent (wax) component from the surface of the toner, thereby giving a good image quality when the image formation is carried out with the toner.

In the toner manufacturing method, it is preferable that the binding resin component in the core-forming toner particle is different from the surface modifier component. In the above method, conditions of, for example, dissolving the surface modifier component only in the SCF while keeping the core-forming toner particle in a solid form can be set with ease. This imposes less restrictions on manufacturing conditions of the toner, thereby stabilizing the surface modification of the toner.

Moreover, with the above method, a toner with separate functions, which prevent the toner from being melted and fixed at improper parts of the image forming apparatus, can be easily provided, for example, by setting melting temperature of the resin component of the surface modifier component to be higher than that of the binding resin component of the core-forming toner particle, while the thus produced toner, as a whole, is set to have a low melting temperature for the fixation, because of the surface modifier component, being a hard-to-melt coating, on the surface of the toner.

In the toner manufacturing method, the surface modifier component may be a polyester resin or an acrylic resin. The method can stabilize the production of the toner, which can perform image formation in a high quality, while deterioration in the coloring of the coloring agent component in the core-forming toner particle is avoided by adapting a polyester resin or an acrylic resin as the surface modifier component.

In the toner manufacturing method, it is preferable that at least one or more types of solvents, which are incompatible with the surface modifier component at ordinary temperature and at ordinary pressure, are blended into the SCF. The above method can prevent the agglomeration of the thus produced toners by the presence of the solvent. Therefore, the toner with the targeted particle diameters can be obtained stably. This can eliminates the needs of post-process, such as grinding or classification of the toner after the toner production, thus cutting the production cost of toner.

In the toner manufacturing method, it is preferred that the coloring agent content is not less than 10% by weight with respect to the binding resin content. With the above method, even a small quantity of the toner can give a desirable image quality, thus contributing to the miniaturization of the image forming apparatus using the toner.

In the toner manufacturing method, it is preferable that the SCF is carbon dioxide. With the above method, low cost of the carbon dioxide can reduce the price of the thus produced toner, thus providing the image forming apparatus with a low running cost. The carbon dioxide, without toxicity and flammability, is also suitable in terms of safety during the toner production.

In the toner manufacturing method, carbon black may be included as the coloring agent component. With the above method, the carbon black as the coloring agent component can give a monochrome toner with a good dispersibility given by the carbon black, and with excellent optical and electrical characteristics, at a lower cost. Further, because a desirable image quality can be obtained with a small quantity of the thus produced toner, the above method is effective for the miniaturization of the image forming apparatus as a whole.

In the toner manufacturing method, a pigment of cyan, magenta, or yellow, may be included as the coloring agent component. With the above method, a toner can be produced with a pigment of cyan, magenta, or yellow as the coloring agent component. Provided thereby is a color toner with a good dispersibility of the coloring agent component, and with excellent optical and electrical characteristics. Further, because a desirable image quality can be obtained with a small quantity of the thus produced toner, the above method is effective for the miniaturization of the image forming apparatus as a whole.

In the toner manufacturing method, a charge control agent component may be included in the SCF. The above method can produce the toner having the charge control agent component concentrated in the vicinity of the surface of the toner, with ease and stability by blending the charge control agent component in the SCF. Thus, the added charge control agent component can be used effectively for controlling charge of the toner. Meanwhile, the interior of the toner, which does not significantly influence the charge control of the toner, has a low probability of the charge control agent component to exist. Thus, quantity of the charge control agent component, which is expensive, can be reduced per toner by unit weight, thereby lowering the price of the product toner.

In the toner manufacturing method, a charge control agent component may be added for coating. The above method can produce the toner having the charge control agent component concentrated in the vicinity of the surface of the toner, with ease and stability by adhering the charge control agent component on the surface. Thus the added charge control agent component can be used effectively for controlling charge of the toner. Meanwhile, the interior of the toner, which does not significantly influence the charge control of the toner, has a low probability of the charge control agent component to exist. Thus, the quantity of the charge control agent component, which is expensive, can be reduced per toner by unit weight, thereby lowering the price of the thus produced toner.

Moreover, the above method has less restrictions in setting conditions in the manufacturing process of the toner, such as setting conditions for dissolving the charge control agent component in the SCF or controlling precipitation order of the charge control agent component, thereby supplies the toner with a stable quality.

As described above, the toner of the present invention is manufactured by either of the above-mentioned methods. Another toner of the present invention, as described above, includes a binding resin component of particle shapes, and a coloring agent component dispersed in the binding resin component, wherein the dispersion of the coloring agent component is carried out by using the SCF.

With the above arrangement, the coloring power of the coloring agent component can be maintained by the excellent dispersibility of the coloring agent component, even when the coloring agent content is set to be high.

As a result, the above arrangement can maintain an excellent image forming ability even when the quantity of toner used is reduced, thereby contributing to the miniaturization of the image forming apparatus using the toner.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A toner manufacturing method, comprising the steps of:

dissolving a binding resin component in a supercritical fluid or a sub-supercritical fluid so that the binding resin component is blended with a coloring agent component; and lowering solubility of the binding resin component in the supercritical fluid or the sub-supercritical fluid so that the binding resin component is precipitated in particle shapes with the coloring agent component dispersed in an interior of the binding resin component;

wherein at least one solvent incompatible with the binding resin component at ordinary temperature and at ordinary pressure is blended into the supercritical fluid or the sub-supercritical fluid.

2. The toner manufacturing method as set forth in claim 1, wherein the solubility of the binding resin component is lowered in the supercritical fluid or the sub-supercritical fluid by rapid expansion, poor solvent introduction, or surfactant introduction.

3. The toner manufacturing method as set forth in claim 1, wherein the supercritical fluid or the sub-supercritical fluid includes a mold releasing agent (wax) component.

4. The toner manufacturing method as set forth in claim 1, wherein the coloring agent component is not less than 10% by weight with respect to the binding resin component.

5. The toner manufacturing method as set forth in claim 1, wherein the supercritical fluid or the sub-supercritical fluid is carbon dioxide.

6. The toner manufacturing method as set forth in claim 1, wherein carbon black is included as the coloring agent component.

7. The toner manufacturing method as set forth in claim 1, wherein a pigment for cyan, magenta, or yellow, is included as the coloring agent component.

8. The toner manufacturing method as set forth in claim 1, wherein a charge control agent component is included in the supercritical fluid or the sub-supercritical fluid.

9. The toner manufacturing method as set forth in claim 1, wherein a charge component is added for coating the particle of the binding resin component with the coloring agent component.

10. A toner manufacturing method, comprising the steps of: polymerizing a monomer as a raw material of a binding resin component in a first supercritical fluid or in a first sub-supercritical fluid so as to produce the binding resin component, which is a polymer;

dissolving the binding resin component in a second supercritical fluid or a second sub-supercritical fluid so that the binding resin component is blended with a coloring agent component;

lowering solubility of the binding resin component in the second supercritical fluid or the second sub-supercritical fluid so that the binding resin component is precipitated in particle shapes with the coloring agent component dispersed in an interior of the binding resin component;

wherein at least one solvent incompatible with the binding resin component at ordinary temperature and at ordinary pressure is blended into the second supercritical fluid or the second sub-supercritical fluid.

11. The toner manufacturing method as set forth in claim 10, wherein the solubility of the binding resin component is lowered in the supercritical fluid or the sub-supercritical fluid by rapid expansion, poor solvent introduction, or surfactant introduction.

12. The toner manufacturing method as set forth in claim 10, wherein the second supercritial fluid or the second sub-supercritical fluid includes a mold releasing agent (wax) component.

13. The toner manufacturing method as set forth in claim 10, wherein the coloring agent component is not less than 10% by weight with respect to the binding resin component.

14. The toner manufacturing method as set forth in claim 10, wherein at least one of (a) the first supercritical fluid or the first sub-supercritical fluid and (b) the second supercritial fluid or the second sub-supercritical fluid is carbon dioxide.

15. The toner manufacturing method as set forth in claim 10, wherein carbon black is included as the coloring agent component.

16. The toner manufacturing method as set forth in claim 10, wherein a pigment for cyan, magenta, or yellow, is included as the coloring agent component.

17. The toner manufacturing method as set forth in claim 10, wherein a charge control agent component is included in the second supercritical fluid or the second sub-supercritical fluid.

18. The toner manufacturing method as set forth in claim 10, wherein a charge control age t component is added for coating the particle of the binding resin component with e coloring agent component.

* * * * *